US006248945B1

(12) United States Patent
Sasaki

(10) Patent No.: US 6,248,945 B1
(45) Date of Patent: Jun. 19, 2001

(54) MUSIC INFORMATION TRANSMITTING APPARATUS, MUSIC INFORMATION RECEIVING APPARATUS, MUSIC INFORMATION TRANSMITTING-RECEIVING APPARATUS AND STORAGE MEDIUM

(75) Inventor: Hiroyuki Sasaki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/452,941

(22) Filed: Dec. 2, 1999

(30) Foreign Application Priority Data

Dec. 18, 1998 (JP) ..... 10-360207

(51) Int. Cl.[7] ..... G10H 7/00; G10H 1/26; G10H 5/00

(52) U.S. Cl. ..... 84/604; 84/609; 84/645; 84/649

(58) Field of Search ..... 84/600–606, 609–610, 84/645, 649–650

(56) References Cited

U.S. PATENT DOCUMENTS

| | | | | |
|---|---|---|---|---|
| 5,300,725 | | 4/1994 | Manabe . | |
| 5,499,922 | | 3/1996 | Umeda et al. . | |
| 5,670,732 | * | 9/1997 | Utsumi et al. | 84/645 |
| 5,880,386 | * | 3/1999 | Wachi et al. | 84/601 |
| 5,886,275 | * | 3/1999 | Kato et al. | 84/609 |
| 5,913,258 | * | 6/1999 | Tamura | 84/604 |

FOREIGN PATENT DOCUMENTS

| | | |
|---|---|---|
| 2 296 123 | 6/1996 | (GB) . |
| 55-12967 | 1/1980 | (JP) . |
| 55-12968 | 1/1980 | (JP) . |
| 55-12969 | 1/1980 | (JP) . |
| 55-25049 | 2/1980 | (JP) . |

* cited by examiner

*Primary Examiner*—Robert E. Nappi
*Assistant Examiner*—Marlon Fletcher
(74) *Attorney, Agent, or Firm*—Frishauf, Holtz, Goodman, Langer & Chick, P.C.

(57) ABSTRACT

A transmitting end transmits to a receiving end event data of an MIDI type with first time data indicative of a timing of processing the event data at the receiving end, and waveform data and second time data indicative of a timing to process the waveform data at the receiving end. The receiving end receives and stores the event data and first time data in a music data buffer. When the receiving end receives the waveform data, it stores it in a waveform buffer. When the receiving end receives the second time data, it starts reproduction of the waveform data stored in the waveform buffer at a timing specified by the received second time data. The start time is incremented at predetermined timings. The event data stored in the music buffer is reproduced at a timing determined based on the start time and first time data stored in the music buffer. As a result, the receiving end is capable of processing a large amount of waveform data, etc., at an appropriate timing irrespective of its reception route.

17 Claims, 29 Drawing Sheets

MUSIC INFORMATION TRANSMITTING APPARATUS, MUSIC INFORMATION RECEIVING APPARATUS, MUSIC INFORMATION TRANSMITTING-RECEIVING APPARATUS AND STORAGE MEDIUM

BACKGROUND OF THE INVENTION

1. Technical Field

The present invention relates to a technique, which causes a receiving end to produce a musical sound, and to perform a melody based on transmission and reception of music information.

2. Background Art

At present, MIDI (Musical Instrument Digital Interface) have diffused and generation of musical sounds at receiving ends based on received music information has become widespread. To this end, musical sound generating apparatus such as an electronic musical instrument, a sound source, and a synthesizer generally include a music information transmitting-receiving apparatus (or one of a music information transmitting apparatus and a music information receiving apparatus).

The above mentioned musical information includes various kinds of musical information. Most of music information actually communicated between the transmitting and the receiving ends is data on an event such as "note on and off," and its data quantity is comparatively small, for example, 2 or 3 bytes. A large quantity of data such as musical waveform data can be sometimes transmitted as musical information.

Transmission of data such as music information takes much time. The transmission time varies depending on generation of an error and the condition of the transmission path. Therefore, there is the problem that when waveform data is transmitted from the transmitting end to the receiving end and then reproduced immediately at the receiving end, the timing of reproducing the waveform (musical sound generating timing) undesirably changes depending on the required transmission time.

A discrepancy in performance or generation timing between melodies or musical sounds very often has such a great musical influence that an impression receiving from the performance of the melody will largely change. Therefore, in the past, waveform data was previously transmitted, and commands for processing the waveform data were transmitted as requested, which imposed substantially large restrictions on the utilization of the waveform data. Therefore, effective use of the waveform data has been strongly demanded.

Diffusion of MIDI has changed a style of playing a musical instrument, a music producing method, and a music style. There has been a long continuing demand for expanding a range of utilization of a musical sound generator and for improving facilities given to users.

DISCLOSURE OF THE INVENTION

An object of the present invention is to expand a range of using of waveform data to be transmitted and received while avoiding musical difficulties such as mentioned above, and also to expand a range of the method of using a musical sound generating apparatus through transmission-reception of music information.

According to one aspect of the present invention, there is provided a music information transmitting apparatus comprising:

event data acquiring means for acquiring event data indicating the contents of a performance effected by a user;

event data transmitting means for transmitting music information obtained by adding first time data indicating a timing which a receiving end should process to the event data obtained by the event data acquiring means;

waveform data acquiring means for acquiring acoustic waveform data;

waveform data transmitting means for transmitting to the receiving end the music information acquired by the waveform data acquiring means; and time data transmitting means for transmitting as music information second time data specifying a timing at which the receiving end should process the waveform data transmitted by the waveform data transmitting means.

According to another aspect of the present invention, there is provided a music information receiving apparatus comprising:

receiving means for receiving music information;

a music data buffer, responsive to the receiving means receiving the event data and first time data as the music information, for storing the received event data and first time data;

a waveform buffer for storing the waveform data;

storage controlling means, responsive to the receiving means receiving the waveform data as the music information, for storing the received waveform data in the waveform buffer;

waveform processing means, responsive to the receiving means receiving the second time data as the music information, for processing the waveform data stored in the waveform buffer at a timing specified by the second time data;

a musical-sound generating time register for storing the received second time data as a musical-sound generating time;

incrementing means for incrementing the musical-sound generating time, stored in the musical-sound generating time register, at predetermined timings; and event processing means for processing the event data stored in the music buffer at a timing determined on the basis of the musical sound generating time stored in the musical-sound generating time register and the first time data stored in the music data buffer.

According to this structure, the receiving end is capable of processing, for example, a large quantity of waveform data or the like at a appropriate timing irrespective of a transmission path.

According to still another aspect of the present invention, there is provided a music information editing apparatus comprising:

transmission requesting means for transmitting a transmission request to a plurality of external devices;

receiving means, responsive to the transmission request transmitted by the transmission requesting means, for receiving from the plurality of external devices music information which comprises event data representing the contents of an event in a performance and time data representing a timing for processing the event data added to the event data;

music information storing means for storing the music information received by the receiving means; and music information editing means for rearranging the music information stored in the music information storing means in accordance with a processing sequence specified by the time data of the music information.

According to this structure, a user is able to freely combine various different music information strings, thereby enjoying a music in various ways.

According to a further aspect of the present invention, there is a music information transmitting apparatus comprising:

music information storing means for storing music information which comprises event data representing the contents of an event in a performance and first time data representing a timing for processing the event data added to the event data;

music information processing means for processing and reproducing an event of the music information stored in the music information storing means;

event data acquiring means for acquiring event data representing the contents of a performance effected by a user during the time when the music information stored in the music information storing means is processed by the music information processing means;

time data adding means for generating second time data representing a timing for processing the event data acquired by the event data acquiring means on the basis of the first time data of the music information stored in the music information storing means, and for adding the generated second time data to the event data acquired by the event data acquiring means;

first transmission means for transmitting as music information the event data and the second time data added to the event data by the time data adding means; and second transmission means for transmitting the music information, stored in the music information storing means, at a timing based on the second time data added to the event data transmitted by the first transmission means.

According to this structure, a user is able to enjoy a session with another performer in a remote place.

According to a still further aspect of the present invention, there is provided a music information transmitting-receiving apparatus comprising:

receiving means for receiving music information transmitted by a plurality of external devices;

music information storing means having a plurality of storage regions corresponding to the plurality of external devices, respectively;

storage controlling means, responsive to reception of music information by the receiving means, for storing the received music information in a corresponding storage region of the music information storing means;

music information processing means for processing and reproducing an event of the music information stored in the music information storing means;

event data acquiring means for acquiring event data representing the contents of a performance effected by a user during the time when the music information stored in the music information storing means is processed by the music information processing means; and transmission means for transmitting the event data acquired by the event data acquiring means to the plurality of external devices, respectively.

According to this structure, a user is able to enjoy a session with another performer in a remote place.

Moreover, according to the present invention, the above mentioned structures may be replaced with corresponding programs executed by a computer.

DETAILED DESCRIPTION OF THE PREFERRED EMBODIMENTS

Embodiments of the present invention will be described next in detail with reference to the accompanying drawings.

<First Embodiment>

Figure 1:
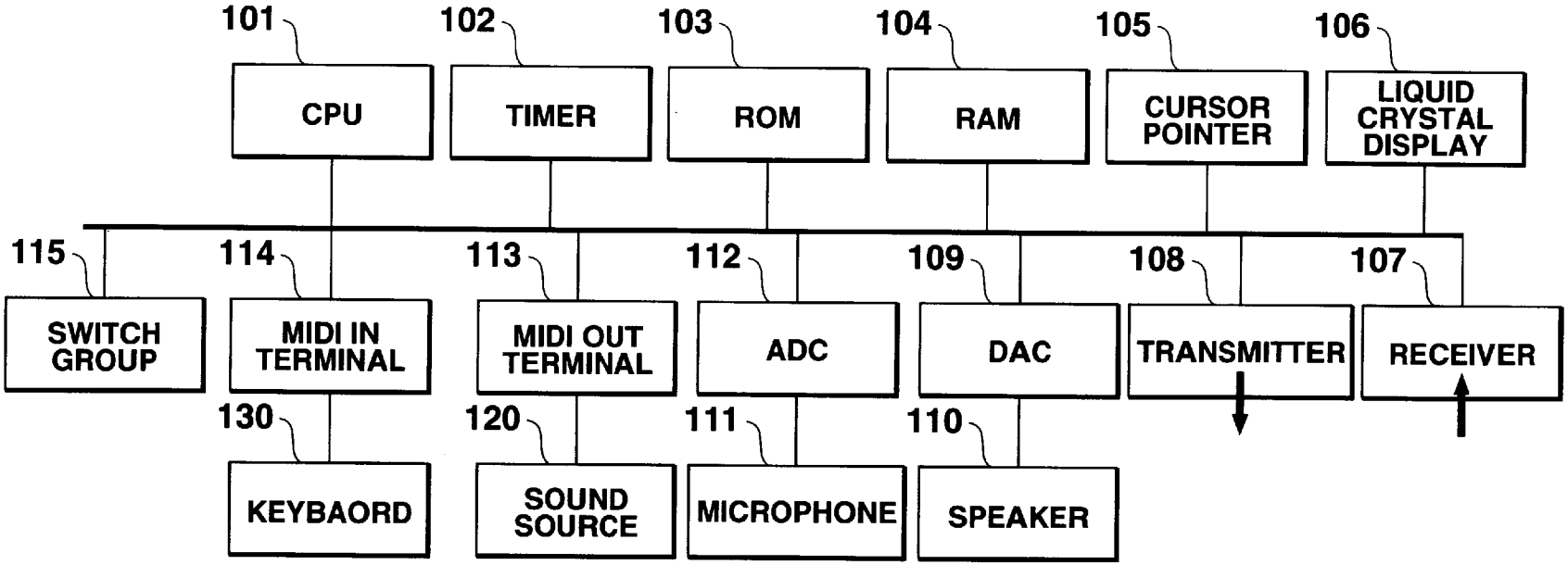
FIG. 1 shows a circuit structure of a musical sound generating apparatus, which includes a music information transmitting-receiving apparatus as a first embodiment of the present invention.

FIG. 1 shows a circuit construction of a musical sound generating apparatus, which includes a music information transmitting-receiving apparatus as a first embodiment of the present invention.

As shown in FIG. 1, the musical sound generating apparatus 100 comprises a CPU 101 for controlling the entire apparatus 100, a timer 102 for counting time, a ROM 103 which contains programs, performance data, and various control data, a RAM 104 to be used to record data on the operation of the CPU 101, a cursor pointer 105 for indicating the position of a cursor displayed on a display screen of a liquid crystal display 106, a receiver 107 for receiving music information transmitted by an external device through a predetermined transmission route, a transmitter 108 for transmitting music information to the external device through the transmission path, a D-to-A converter 109 for converting digital waveform data received from the CPU 101 to analog data, a speaker 110 for outputting a sound based on analog waveform signal outputted by the converter 109, a microphone 111 for collecting ambient sounds and for outputting an analog sound signal, an A-to-D converter 112 for converting the analog sound signal outputted from the microphone 111 to digital waveform data, an MIDI OUT terminal 113 for outputting MIDI data received from the CPU 101 to a sound source 120, an MIDI IN terminal 114 for receiving the MIDI data outputted from a keyboard device 130, and a switch group 115 of various switches.

The above transmission route includes, for example, a LAN, WAN or public network. In the music generating apparatus 100 of the first embodiment, the music information transmitting-receiving apparatus transmits and receives MIDI data to and from the external devices through the MIDI IN terminal 114 and the MIDI OUT terminal 113, and also transmits and receives music information to and from nodes (devices) connected with the network through the receiver 107 and the transmitter 108.

For convenience's sake, assume that the receiver 107 and the transmitter 108 receive and transmit data from and to other devices through a LAN. According to this assumption, the transmitter 108 and the receiver 107 compose a single device, but those terms will be used as they are for the purpose of clarifying discrimination between transmission and reception of data. There are several methods of transmitting and receiving data through the LAN. For convenience's sake, assume herein that data is transmitted and received through a server (not shown).

The external devices connected to the MIDI OUT terminal 113 and the MIDI IN terminal 114 should not be limited to the sound source device 120 or the keyboard 130, and may be connected freely to an automatic performer, electronic musical instruments or devices with a MIDI terminal such as a controller.

In operation, when an electric power source is turned on, the CPU 101 reads out and executes a program from the ROM 103, thereby starting control of the entire apparatus 100. At that time, for example, the timer 102 may be actuated to start a time counting operation. Then, the RAM 104 is used for a work area while the CPU 101 provides control on the basis of information obtained from respective input devices of the switch group 115, MIDI IN terminal 114 (keyboard 130), A-to-D converter 112, and receiver 107.

Although not detailed, the switch group 115 comprises switches (hereinafter referred to as type selecting switches) for specifying a type, tone quality and destination device for information to be displayed, for example, on the liquid crystal display device 106, various switches (hereinafter referred to as general-purpose button group) including a plurality of buttons for specifying a destination device, tone quality, and melody to be displayed as a musical score on the liquid crystal display device 106, and a detection circuit for detecting their respective operational states. The detection circuit scans those switches, for example, in accordance with an instruction from the CPU 101, and sends a result of the scan as operation information to the CPU 101.

The CPU 101 analyzes the operation information received from the switch group 115 and specifies a switch operated by a user and the contents of its operation. Thus, the CPU 101 recognizes the contents of the user's instruction, effects different settings in accordance with a result of the recognition, and controls the entire apparatus 100 in accordance with the settings. For example, if the user instructs the apparatus to display a musical score, the CPU 101 reads out its image data from the ROM 103, and transfers it to VRAM (not shown) of the liquid crystal display device 106, thereby displaying the musical score specified by the user on the liquid crystal display device 106. On the other hand, if the user depresses an appropriate button of the general-purpose button group after selecting a destination device with the type selecting switch, the CPU 101 sets a destination device in accordance with the depression of the appropriate button. In general, rewriting the values of variables prepared for the respective types effects the various settings.

The keyboard device 130 outputs the contents of the user's manipulation on the keyboard and various switches in the form of MIDI data. If the CPU 101 receives MIDI data through the MIDI IN terminal 114, the CPU 101 delivers it to the MIDI OUT terminal 113, thereby causing the sound source 120 to generate or mute a musical sound. If a destination device to which the music information is transmitted is specified, the CPU 101 adds an identifier representing transmission of the MIDI data and time data representing a timing of processing the identifier to the MIDI data received through the MIDI IN terminal 114, and causes the transmitter 108 to transmit the resulting data as music information. The time data is a value of a variable (present time register) updated, for example, in accordance with a value of the timer 102.

When a microphone 111 is connected to a terminal in a jack (not shown), the A-to-D converter 112 samples a voice signal outputted from the microphone 111 and outputs digital waveform data.

The CPU 101 delivers the waveform data received from the A-to-D converter 112 to the D-to-A converter 109. Thus, the speaker 110 audibly outputs sounds collected by the microphone 111 on a real time basis. If a destination device is specified, two regions for storing the waveform data are secured in the RAM 104. The waveform data are stored alternatively in the two regions (PCM recording) and the waveform data stored in one of the regions are sequentially transmitted as music information from the transmitter 108. The identifier representing transmission of the waveform data is added to the waveform data upon its transmission.

As mentioned above, according to the present embodiment the waveform data is divided and transmitted in units of a capacity of each of the two secured regions, in order that the waveform data can be intermittently transmitted so that other music information (for example, MIDI data) can be transmitted between periods of waveform data transmission, in other words, in order that even if any transmission path may be used, different types of music information can be transmitted in parallel.

The two regions secured for storing (and transmitting) the waveform data are hereinafter referred to as waveform buffers A and B for convenience's sake. When the two regions are not required to be clearly discriminated from each other, they are each hereinafter referred to as waveform buffer simply. In the present embodiment, the capacity of each of the waveform buffers is 256 bytes.

Each time waveform data is transmitted in units of a capacity of the waveform buffers, a command to reproduce the waveform data (hereinafter referred to as a reproduction command) is transmitted. If the receiving end can not receive the waveform data normally, noise may be reproduced undesirably as a result. Under the circumstances, the transmitter 108 transmits to the receiving end the command along with additional data by which the receiving end can determine whether the data quantity transmitted so far has been received normally or not, and further along with time data representing a timing of starting reproduction of the waveform data. Those data compose music information. The time data is a value of a variable (in the recording time register) updated, for example, on the basis of the value of the timer 102.

By specifying the timing data for reproducing the waveform data added to the reproduction command for the destination device, as described above, the receiving end can absorb possible fluctuations of the transmission times for the respective waveforms. Thus, even when a transmission path is used in which the required transmission time fluctuates, the receiving end can reproduce the waveform data at an appropriate timing. Therefore, the occurrence of musical difficulties due to the transmission path, situation and the like is avoided and the waveform data can be used appropriately for a performance. Therefore, a range of utilization of the waveform data expands.

Receiving the waveform data, the receiving end can produce various sounds without any limitation. Thus, the latitude of musical expression expands, thereby contributing to creation of a new style of music.

Now, the data structure of the music information transmitted as mentioned above will be described. For convenience's sake, assume that there are five kinds of music information; that is, MIDI data, waveform data, reproduction command, image (bit map) data of a musical score, and point data indicating a performance position on the musical score.

The MIDI data contains no exclusive message, for example, in this case. This MIDI data has a variable length of 1 to 3 bytes. However, for the sake of simplifying the processing, the MIDI data is assumed as having a fixed length of 4 bytes in the present embodiment. The time data to be added to the MIDI data is assumed having 4 bytes representing a time, for example, with a unit of a millisecond. Therefore, when MIDI data is transmitted as the music information, the data quantity is of 8 bytes in total.

If data excluding the MIDI data is transmitted as the music information, two byte data are allocated for storing an identifier (corresponding to a command given to the destination device) representing the kind of the music information, instead of the MIDI data and time data. If the contents of the identifier are expressed in the form of (a first byte, a second byte), (0,0) represents the waveform data; (1,0) the reproduction command; (2,0) the image data; and (3,0) the point data. The data structure of the music information with those identifiers is as follows.

First, in the waveform data to which the identifier (0,0) is allocated, the identifier is accompanied by the total number of bytes of the waveform data, a serial number of the waveform data, and the waveform data in this order. The units of the data (for example, representing the number of bytes of the identifier and waveform data) composing music information are each referred to as a word herein.

In the reproduction command to which the identifier (1,0) is allocated, the identifier itself represents the reproduction command. The identifier acting also as the command is accompanied by the total number of bytes of the waveform data, and a reproduction timing. The second word is used for a receiver to determine whether the second data as well as the waveform data has been normally received.

In the image data to which the identifier (2,0) is allocated, the image data is annexed to the identifier, and no time data is annexed. This is because a musical score is assumed to be transmitted as the image data and the musical score is required to be transmitted before start of the performance.

In the point data to which the identifier (3,0) is allocated, the identifier is accompanied by x-coordinate data for specifying a position on the x coordinate axis, and y-coordinate data for specifying a position on the y coordinate axis. No time data is annexed either. This is because the precision of a time required for switching display of the image data is low compared to generation of a musical sound.

The CPU 101 causes the transmitter 108 to transmit the music information in the form mentioned above. Such music information is received by the receiver 107 when the musical sound generating device 100 is specified as a destination device for the musical information by another node.

Actually, the music information is transmitted along with a header which contains control data related to transmission such as a transmission source and a destination device. The music information transmitted is held in the server. The destination device for the music information inquires of the server whether there is received data for the receiver or not. As a result, if it is ascertained that there is new received data, the receiver obtains the data from the server by downloading. As mentioned above, the music information is communicated through the server.

When the receiver 107 receives the music information, the receiver 107 notifies the CPU 101 of the fact and then transmits the received music information to the CPU 101.

Receiving the music information from the receiver 107, the CPU 101 determines the kind of the music information from a value of the two-byte data positioned at its head. Then, the CPU 101 processes the music information on the basis of the results of the determination.

Moreover, in the case of MIDI data, the value of its first-byte data is equal to, or above, F0H (H is represented by a hexadecimal notation), and the identifier is data of two bytes. As apparent from this, the kind of the music information can be determined from the value of the head two-byte data.

When the music information is ascertained as MIDI data, the CPU 101 transmits the MIDI data to the sound source device 120 through the MIDI OUT terminal at a timing specified by the time data attached to the MIDI data.

As in transmission of the waveform data, two regions for storing the received waveform data are secured in the RAM 104. When the music information is ascertained as waveform data, the CPU 101 stores the waveform data alternately in the two regions each time the waveform data is received. On the other hand, the CPU 101 calculates the total number of bytes of the waveform data so far received, and substitutes the result of the calculation into a variable HSSR. The two regions are hereinafter referred to as reception waveform buffers A and B, respectively. If one of them is not required to be discriminated from the other, it is merely referred to as the reception waveform buffer. In the present embodiment, the capacity of the reception waveform buffer is set at 256 bytes equal to that of the transmission waveform buffer.

When the music information is ascertained as a reproduction command, the CPU 101 determines whether the value of a second word from the head of the music information coincides with the value of the variable HSSR or not. If the waveform data transmitted so far is normally received, those values coincide. In this case, the reproduction of the waveform data stored in the reception waveform buffer starts when a timing specified by the time data of the music information has come. If both the values do not coincide, the CPU 101 stops reproduction of the waveform data as an error being involved in the reception of the waveform data to thereby avoid reproduction of a sound which may impair the performance. The CPU 101 in such a manner that the CPU 101 reads out one-sample waveform data sequentially from the received waveform buffer at sampling periods and transmits them sequentially to the D-to-A converter 109 effects the reproduction of the waveform data.

If the music information is ascertained as image data, the CPU 101 stores the image data followed by the identifier representing that fact in VRAM (not shown) provided in the liquid crystal display device 106. The CPU 101 sets in the cursor pointer an initial value representing that the image data should be displayed from its head and hence displays the head of the musical score transmitted as the image data on the picture of the liquid crystal display device 106.

Although not detailed especially, a plurality of such image data are stored in the ROM 103, and one of the image data is selected by the user with the switch group 115. Thus, the CPU 101 transmits the image data selected by the user as the music information.

The cursor pointer 105 specifies a display position of the cursor (not shown) in the xy coordinate system. A register which stores a value representing a position on the x coordinate axis is hereinafter referred to as a cursor x register, and a register which stores a value representing a position on the y coordinate axis is hereinafter referred to as a cursor y register. The CPU 101 updates those values in accordance with the progress of the performance, for example, on the basis of the contents of a musical score (play data) displayed on the display device 106, the time counted by the timer 102, and a set tempo value. Thus, the CPU 101 moves the position of the cursor on the musical score in accordance with the progress of the performance, and updates the displayed contents of the musical score (e.g. by scrolling). Of course, the registers each may be a variable.

Receiving image data and then point data as the music information, the CPU 101 stores the second and third data of the music information in the cursor x and y registers, respectively, each time music information determined as point data is received. Thus, the CPU 101 moves the position of the cursor displayed on the picture of the liquid crystal display device 106 to a position specified by the received point data.

Referring now to FIGS. 2 to 12, the operation of the CPU 101 involving the control as mentioned above will be described next in more detail. Since the present invention relates to the transmission-reception of music information, the transmission and reception of the music information will be described mainly here for the sake of easy understanding.

Figure 2:
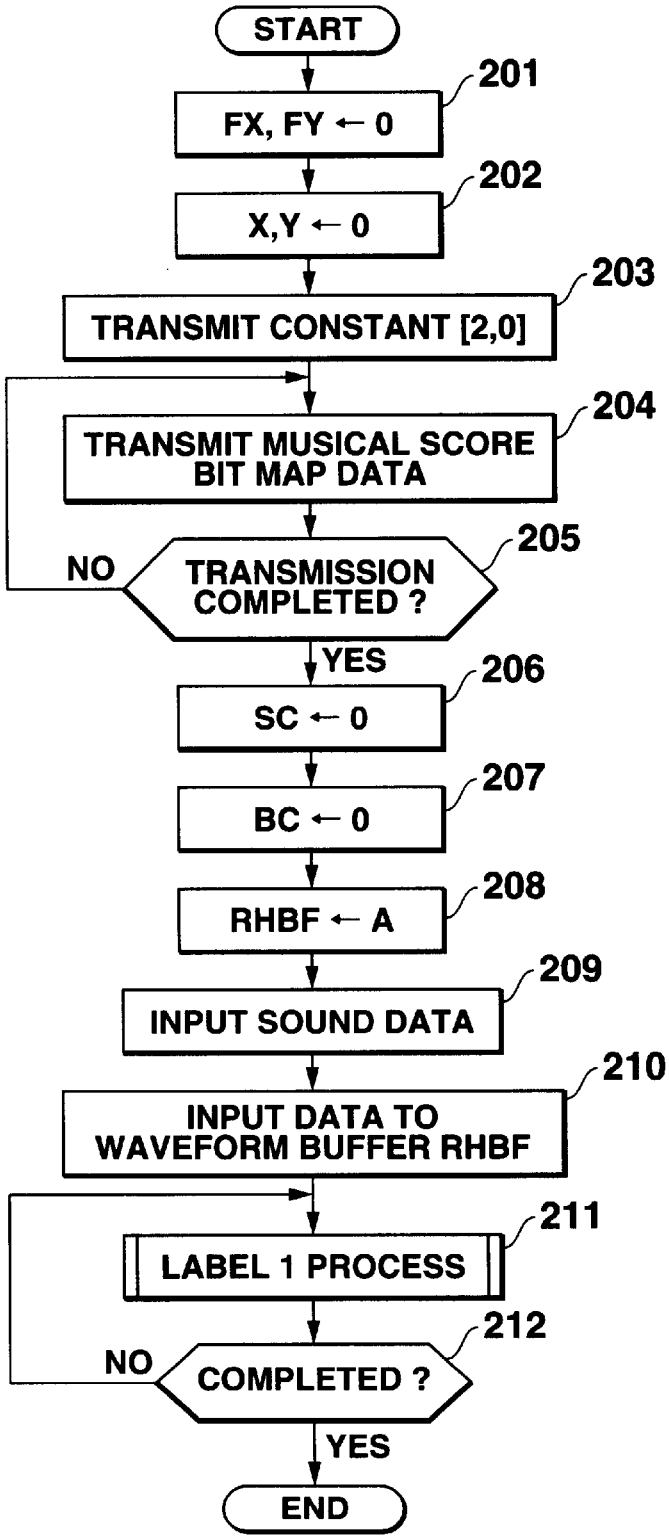
FIG. 2 is a flowchart of a music information transmitting process.

FIG. 2 is a flow chart of a music information transmitting process, which includes an extraction of a flow of processing the music information in its transmission. For convenience's sake, it is assumed to transmit the waveform data, image data (musical score), and point data as the music information. Initially, the operation of the CPU 101 involving the transmission of the music information will be described in detail with reference to FIGS. 2 to 4.

Figure 3:
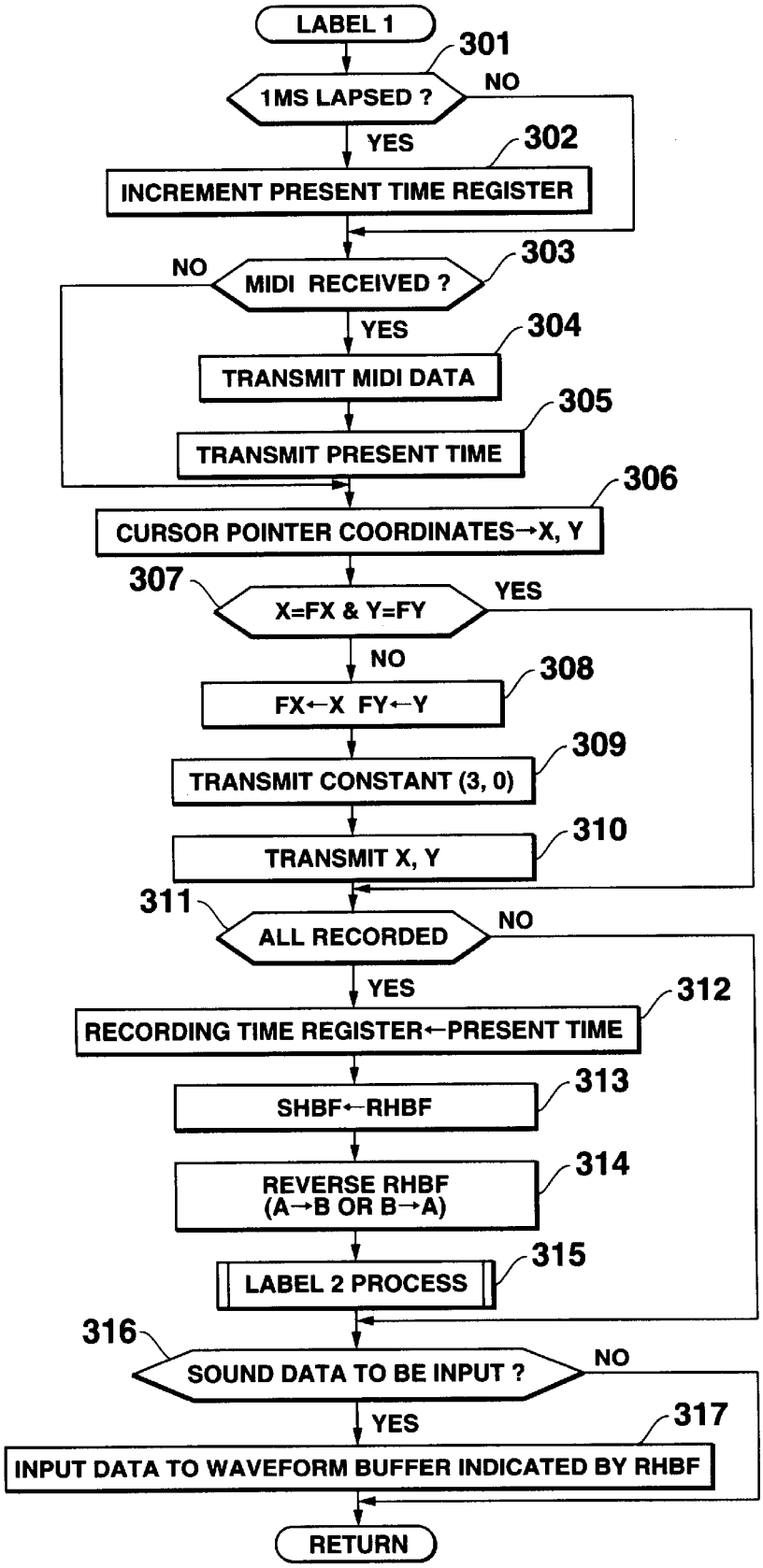
FIG. 3 is a flowchart of a label 1 process.
Figure 4:
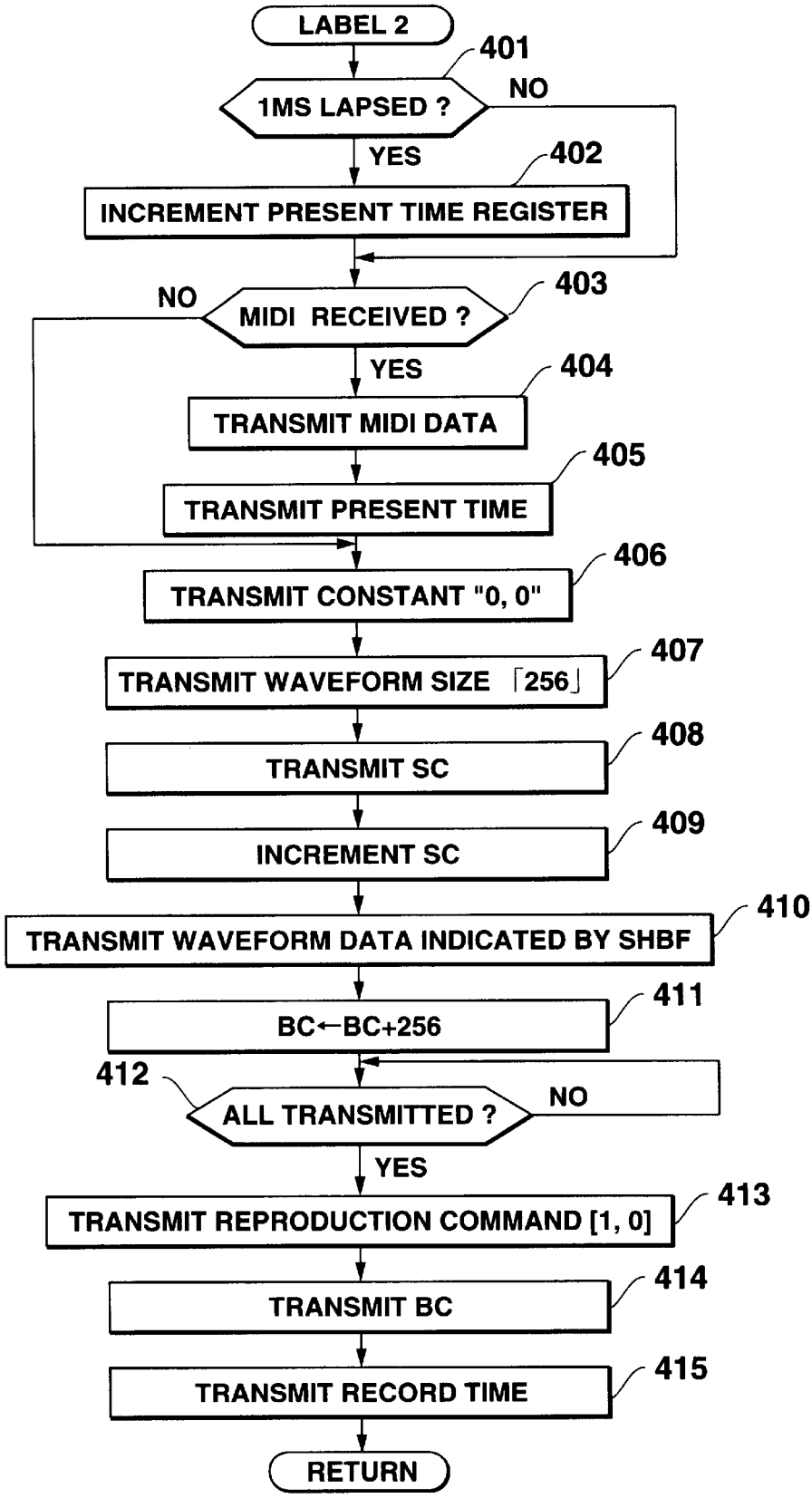
FIG. 4 is a flowchart of a label 2 process.

The music information transmitting process shown in FIG. 2, (including subroutine processes as shown in FIGS. 3 and 4) is realized when the user has specified a destination device by manipulating the switch group 115 and hence the CPU 101 executes a related program stored in the ROM 103.

First, in step 201, the CPU 101 also substitutes zeros into variables FX and FY. In step 201, the CPU 101 also substitutes zeros into the variables x and y, and then shifts its control to step 203.

The variables FX and FY are used for the CPU 101 to manage the display position of the cursor. The variables x and y are used to update the variables FX and FY.

In step 203, the CPU 101 transmits a constant (2,0) of two bytes where 2 is a value of a first byte, and 0 is a value of a second byte. This applies similarly hereinafter. The constant (2,0) is an identifier representing transmission of the image data (bit map data of the musical score in this embodiment) as the music information.

In step 204 following step 203, the CPU 101 reads out the image data selected by the user with the switch group 115 from the ROM 103, delivers it to the transmitter 108, and causes the transmitter 108 to transmit it. In the next step 205, the CPU 101 determines whether the transmission of the image data has been completed or not. If the transmission is not completed, the determination becomes NO, and the CPU 101 returns its control to step 204, where the CPU 101 causes the transmitter 108 to continue the transmission. If the transmission has been completed, the determination becomes YES, and the CPU 101 shifts its control to step 206.

As described above, in steps 201 to 205, the CPU 101 effects the initial setting of the display position of the cursor and the transmission of the image data. In the present embodiment, in step 204 the CPU 101 transfers the required image data to the VRAM of the liquid crystal display device 106, thereby displaying the musical score on its display screen because it is supposed that transmitter 108 transmits as the musical information the contents of the user's performance effected by seeing the musical score.

In step 206, the CPU 101 substitutes zero into a variable SC for counting the number of transmissions of divided waveform data. In the next step 207, the CPU 101 substitutes zero into a variable BC for holding the total number of bytes of the waveform data transmitted. Then, the CPU 101 shifts its control to step 208, where the CPU 101 substitutes a value A or B representing the transmit waveform buffer A or B into a variable RHBF which manages the area which stores the waveform data. Then, the CPU 101 shifts its control to step 209.

In step 209, voice data is input to the A-to-D converter 112, which outputs corresponding waveform data. In the following step 210, the CPU 101 stores the waveform data in the transmit waveform buffer designated by the variable RHBF. Then, the CPU 101 shifts its control to step 211. The A-to-D converter 112 converts an analog sound signal outputted from the microphone 111 to a digital signal and outputs it. Therefore, the waveform data is hereinafter referred to as sound data.

In step 211, the CPU 101 effects a label 1 process for transmitting the music information in accordance with a change in the conditions. Then in step 212, the CPU 101 determines whether completion of the transmission of the music information is specified or not. When the user specified the completion of the transmission of the music information by operating a predetermined switch of the switch group 115, the determination becomes YES, and the CPU 101 thereby terminates the process. If otherwise in step 212, the determination becomes NO and the CPU 101 returns its control to step 211. Thus, the CPU 101 iterates the label 1 process in step 211 until the user specifies the completion of the transmission.

The above mentioned steps 201 to 210 are effected as an initial setting process for starting the transmission of the music information and a process subsequent to the initial setting process. Changes in the conditions such as reception of MIDI data and loss of an empty area of the transmit waveform buffer which stores sound data are coped with by effecting the label 1 process in step 211.

FIG. 3 is a flowchart of the label 1 process in step 211. Referring to FIG. 3, the subroutine process to be executed in the process for transmitting the music information will be described hereinafter.

As mentioned above, a unit of time data representing a timing is millisecond. The timer 102 counts time in units of a time smaller than a millisecond. Therefore, according to the present embodiment, a variable for holding the present time is prepared, and a value of the variable is updated in accordance with a lapse of time counted by the timer 102. The variable is hereinafter referred as a present time register.

First, in step 301 the CPU 101 determines whether or not one millisecond has lapsed since update of the value of the register in order to update the value of the present time register each time one millisecond elapses. When the present value of the timer 102 is larger by a value corresponding to at least one millisecond than the last updated value of the present time register, the determination becomes YES. Then, the CPU 101 shifts its control to step 302 to increment the value of the register and then to step 303. If otherwise in step 301, the determination becomes NO and the CPU 101 shifts its control to step 303.

In step 303 the CPU 101 determines whether the MIDI IN terminal 114 has received the MIDI data or not. If the user has operated the keyboard 130, the keyboard 130 outputs MIDI data. Therefore, the determination becomes YES, and the CPU 101 shifts its control to step 304. If the user does not operate the keyboard 130, the determination becomes NO, and the CPU 101 shifts its control to step 306.

In step 304, the CPU 101 delivers the MIDI data received by the MIDI IN terminal 114 to the transmitter 108 to cause the transmitter 108 to transmit it. Then in step 305, the CPU 101 delivers the value of the present time register to the transmitter 108 to cause the transmitter 108 to transmit it as the time data. Then, the CPU 101 shifts its control to step 306. Actually, the MIDI data and the time data are transmitted from the transmitter 108 as one packet.

In step 306, the CPU 101 reads out the values of the cursor X and Y registers of the cursor pointer 102 and substitutes them into the variables X and Y, respectively. Then in step 307, the CPU 101 determines whether or not the value of the variable FX is equal to the value of the variable X and also whether or not the value of the variable FY is equal to the value of the variable Y. When the display position of the cursor indicated by the cursor pointer 102 changes from its preceding position, the value of the variable FX is different from the value of the variable X or the value of the variable FY is different from the value of the variable Y. Therefore, the determination becomes NO and the CPU 101 shifts its control to step 308. If otherwise in step 307, the CPU 101 shifts its control to step 311.

A change in the display position of the cursor means the necessity of changing the display position of the cursor at the receiving end. Thus, in steps 308 to 310, the CPU 101 effects a process for transmitting the point data as the music information.

First, in step 308, the CPU 101 substitutes the value of the variables X and Y into the variables FX and FY, respectively, thereby updating the values of the variables FX and FY. In the following step 309, the CPU 101 causes the transmitter 108 to transmit a constant (3,0) representing the transmission of the point data as the music information. After the transmission, the CPU 101 shifts its control to step 310, where the CPU 101 causes the transmitter 108 to transmit the values of the variables X and Y. Then, the CPU 101 shifts its control to step 311. The transmitter transmits the identifier and variables as one packet.

In step 311 and subsequent steps, the CPU 101 stores the sound data in the transmit waveform buffer to another, selects the other transmit waveform buffer, and transmits the sound data stored in the transmit waveform buffer.

First, in step 311 the CPU 101 determines whether or not recording the transmit waveform buffer in units of a capacity has been completed. When an empty space in the transmit waveform buffer specified by the value of the variable RHBF is lost, the determination becomes YES and the CPU 101 shifts its control to step 312. If otherwise in step 311, the determination becomes NO, and the CPU 101 shifts its control to step 316.

In step 312, the CPU 101 substitutes the value of the present time register into the record time register. In the following step 313, the CPU 101 substitutes the value of the variable RHBF into the variable SHBF for managing the transmit waveform buffer which has stored the sound data to be transmitted. Then, the CPU 101 shifts its control to step 314.

In step 314, the CPU 101 reverses the value of the variable RHBF. More specifically, if the value of the RHBF has been A, it is rewritten with B, and vice versa. If this rewriting is completed, the CPU 101 shifts its control to step 315, where the CPU 101 effects a label 2 process for transmitting the music information including the sound data.

Then, the CPU 101 shifts its control to step 316, where the CPU 101 determines where the timing for inputting the sound data has come or not. The CPU 101 gets the sound data outputted from the A-to-D converter 112 at predetermined sampling periods. Thus, when a time corresponding to one sampling period has lapsed since the output of the A-to-D converter 112 was gotten last, the determination becomes YES, and the CPU 101 shifts its control to step 317. If otherwise in step 316, the determination becomes NO, and the CPU 101 thereby terminates the process.

As described above, in the present embodiment, each time the sound recording of sound data at a capacity unit of the transmit waveform buffer is completed, the transmit waveform buffer storing the sound data is switched to the other to continue recording the sound data (storage). The sound data stored so far in the unswitched transmit waveform buffer is transmitted when the label 2 process described hereinafter is effected. Thus, it is avoided that the waveform buffer storing the sound data is the same as the waveform buffer for transmitting the sound data.

FIG. 4 is a flowchart of a label 2 process to be effected in step 315. Referring to FIG. 4, the label 2 process will be described next in detail. The present time register and the recording time register are transferred as arguments from the label 1 process to the label 2 process.

First, in step 401, the CPU 101 determines whether or not one millisecond has lapsed since the value of the present time register was updated, in order to update the value of the present time register at each lapse of one millisecond. If the present value of the timer 102 is larger by a value corresponding to at least one millisecond than the preceding updated value of the present time register, the determination becomes YES, and the CPU 101 shifts its control to step 402, where it increments the value of the present time register, and then to step 403. If otherwise in step 401, the CPU 101 shifts its control to step 406.

In step 403, the CPU 101 determines whether or not the MIDI IN terminal 114 has received MIDI data. If the user manipulates the keyboard 130, the keyboard 130 outputs MIDI data. Therefore, the determination becomes YES, and the CPU 101 shifts its control to step 404. If otherwise in step 403, the determination becomes NO, and the CPU 101 shifts its control to step 406.

In step 404, the CPU 101 delivers the MIDI data received by the MIDI IN terminal 114 to the transmitter 108, which is then caused to transmit it. In the following step 405, the CPU 101 delivers the value of the present time register to the transmitter 108, which is then caused to transmit it as the time data. Then, the CPU 101 shifts its control to step 406. As mentioned above, the MIDI data and the time data are transmitted together as one packet.

In steps 406 to 411, the CPU 101 effects a process for transmitting the sound data (waveform data) as the music information.

First, in step 406, the CPU 101 causes the transmitter 108 to transmit a constant (0,0) representing the transmission of sound data as sound information. Similarly, the CPU 101 causes the transmitter 108 to transmit "256", which is the number of bytes representing the capacity of the waveform buffer, as the number of bytes of sound data, and then the value of a variable SC as a serial number (steps 407 and 408). Then, the CPU 101 increments the value of the variable SC in step 409 and the CPU 101 then shifts its control to step 410.

In step 410, the CPU 101 delivers the waveform data stored in the waveform buffer specified by the value of the variable SHBF to the transmitter 108, which is then caused to transmit it. Then, the CPU 101 shifts its control to step 411 where the CPU 101 updates the value of the variable BC. In this case, since 256 bytes of acoustic data is transmitted, a value obtained by adding 256 bytes of the transmitted sound data to the last value of the variable BC is substituted newly into the variable BC. The sound data is actually transmitted as one packet, starting with the constant (0,0) as the identifier.

Then in step 412, the CPU 101 waits for the transmitter 108 to complete transmission of the sound data delivered in step 410. Then, the CPU 101 shifts its control to step 413.

Transmission of all the sound data means completion of transmission of the music information. Thus, in step 413 and subsequent steps, the CPU 101 effects a process for transmitting as music information a command for reproduction of the transmitted sound data.

First, in step 413, the CPU 101 causes the transmitter 108 to transmit a constant (1,0) representing transmission of a reproduction command as music information. Then, the CPU 101 causes the transmitter 108 to transmit the value of the variable BC as the total number of bytes of the sound data, and then the value of the record time register as the time data (steps 414 and 415). Then, the CPU 101 terminates the process. The time data is actually transmitted as one packet, starting with the constant (1,0) which also indicates the reproduction command.

Thus, in the present embodiment, the image data (bit map data of a musical score) is transmitted prior to transmission of music information for an actual performance, the MIDI data is transmitted each time the music information is received, the point data is transmitted as requested, the sound data is transmitted each time an empty space in the waveform buffer is lost, and the reproduction command is transmitted each time the sound data is transmitted.

Moreover, while in the present embodiment the sound data is illustrated as being transmitted separately from the reproduction command for convenience's sake, the reproduction command may be not transmitted. The sound data may be transmitted along with the time data and various other data for determining whether the sound and time data should be reproduced or not.

Figure 5:
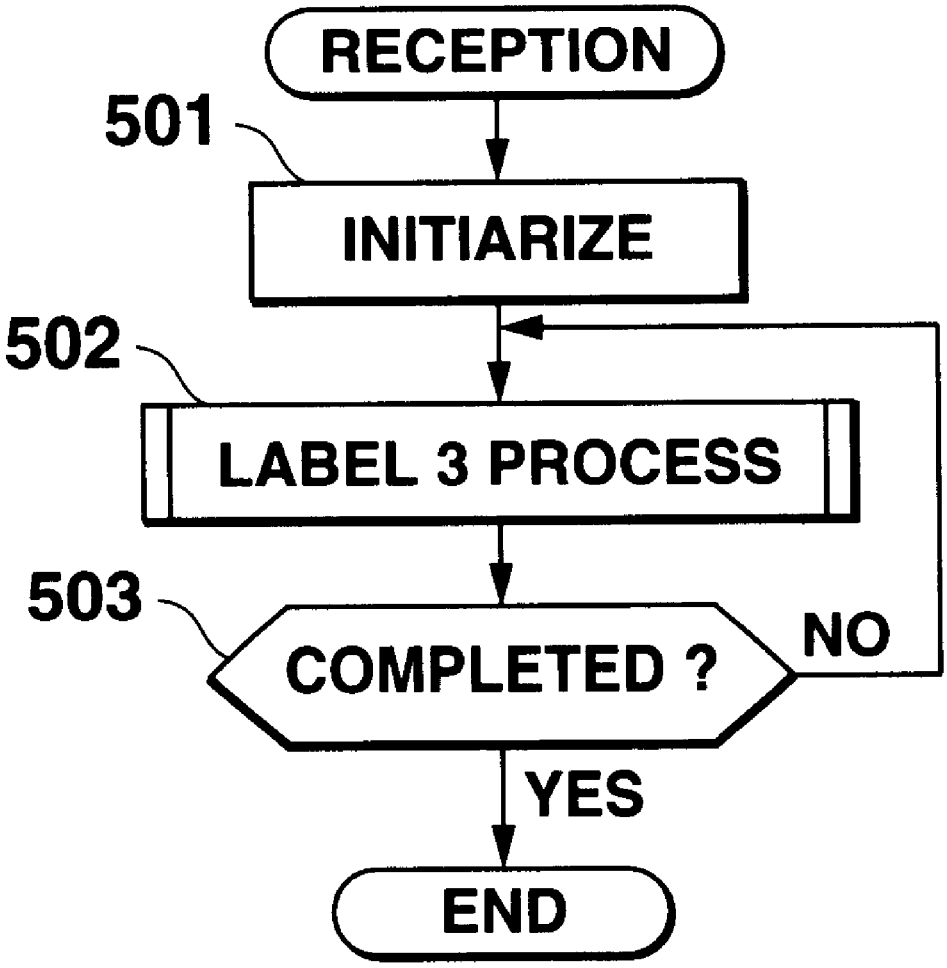
FIG. 5 is a flowchart of a music information receiving process.

Referring now to FIG. 5, the operation of the CPU 101 effected upon reception of the music information will be described in detail. FIG. 5 is a flowchart of a music information receiving process.

It is impossible for the user to previously know when data for the user will be received. Therefore, when the receiver 107 is connected to a network (LAN in this case), the music information receiving process is effected when the CPU 101 executes a program stored in the ROM 103 after the power source is turned on.

The music information transmitted as mentioned above is held in the server, and therefore can be received by downloading from the server. The user can know whether there is transmitted data for the user by inquiring the server of it.

First, in step 501, the CPU 101 effects an initializing process including substituting initial values into the various variables in preparation for start of reception of the music information. The substitution of the initial values into the variables includes substituting 0's into the variable JBC for holding the number of bytes of the received sound data, the variable JSC for managing the serial number of the sound data, and the variable HSSR for managing the total number of bytes of the received sound data; securing a reception waveform buffer for storing the received sound data; and substituting a character "A" representing the reception waveform buffer A into the variable JHBF for managing an area which stores the received sound data. Thus, if the initialization is completed, the CPU 101 shifts its control to the next step 502.

In step 502, the CPU 101 executes a label 3 process which includes determining the contents of the music information received from the receiver 107, and effecting a corresponding process. In the next step 503, the CPU 101 determines whether the receiver 107 is disconnected from the server. If the user disconnects the receiver from the server, the determination becomes YES by regarding the reception of the music information as completed, and the CPU 101 thereby terminates the process. If otherwise in step 503, the determination becomes NO, and the CPU 101 returns its control to step 502, thereby executing the label 3 process. Thus, the CPU 101 iterates the label 3 process in step 502 until reception of the music information is completed.

Figure 6:
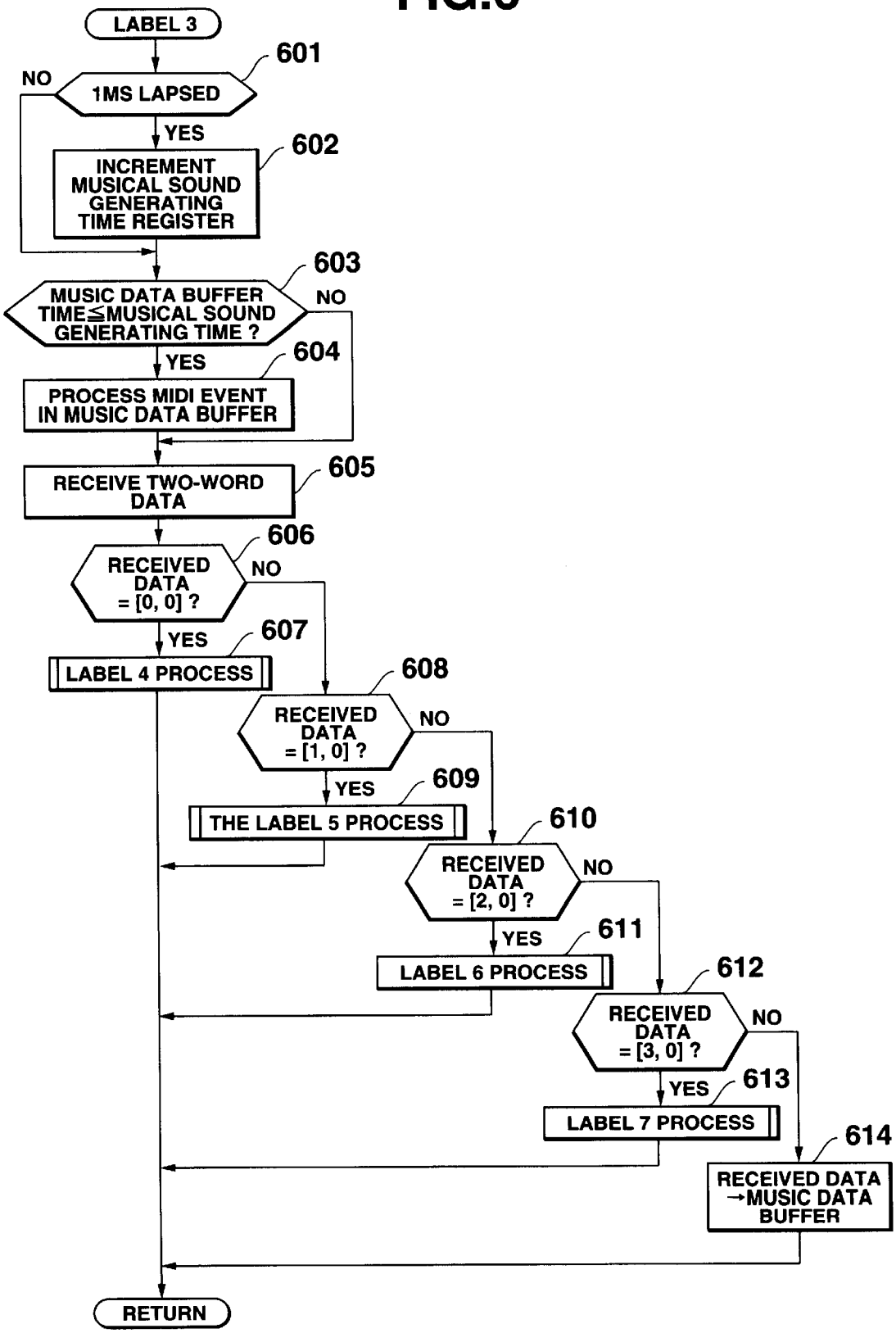
FIG. 6 is a flowchart of a label 3 process.

FIG. 6 is a flowchart of the label 3 process to be executed in step 502, which will be described in more detail hereinafter. The transmission source transmits music information along with time data added depending on the kind of the music information. The time data represents a time counted in units of one millisecond by the transmission source.

Therefore, in the present embodiment, a variable prepared for processing the music information is used to count a time, this counted time is compared with the time represented by the received time data, and the music information is processed at a timing specified by the result of the comparison. For convenience's sake, the variable will be hereinafter referred to as a musical sound generating time register.

First, in step 601 the CPU 101 determines, using the timer 102, whether one millisecond has elapsed or not since the value of the musical sound generating time register was updated last. When the present time of the timer 102 is larger by a value corresponding to at least one millisecond than the last updated value of the register, the determination becomes YES, the CPU 101 increments the value of the register in step 602, and then shifts its control to step 603. If otherwise in step 601, the determination becomes NO, and the CPU 101 shifts its control to step 603.

In the present embodiment, a region for storing MIDI data received as the music information (referred to as a music data buffer hereinafter) is provided in the RAM 104. MIDI data is stored together with its received time data in the buffer each time the MIDI data is received, and the MIDI data is processed at a timing specified by the time data. In step 603, the CPU 101 determines whether there is any unprocessed MIDI data stored in the music data buffer and whose processing timing has come. When MIDI data in which the time represented by the added time data is earlier than the time represented by the value of the musical sound generating time register is stored in the music data buffer, the determination becomes YES. Thus, the CPU 101 processes MIDI data in step 604 and then shifts its control to step 605. If otherwise in step 603, the determination becomes NO, and the CPU 101 shifts its control to step 605. The processing of the MIDI data is executed by the CPU 101 in such a manner that the CPU 101 reads out the MIDI data from the music data buffer of the RAM 104 and sends it to the sound source device 120 through the MIDI OUT terminal 113.

In step 605, the user inquires the server through the receiver 107 of whether there is transmitted data for the user. If so, the user receives the data by down-loading. The CPU 101 then fetches a head two-word item of the data. The two-word data item includes an item of MIDI data and time data if the music information is the MIDI data, and an identifier of two byte data if it is music information other than the MIDI data. Step 606 and subsequent steps are executed depending on the kind of the music information specified by the data.

First, in step 606 the CPU 101 determines whether a value represented by the data is (0,0) or not. When the receiver 107 has received the sound data as the music information (down-loaded from the server), the determination becomes YES. Thus, the CPU 101 effects a label 4 process involving receiving the sound data in step 607 and then terminates the process. If otherwise, namely, if the receiver 101 has received the music information other than the sound data, the determination becomes NO, and the CPU 101 shifts its control to step 608.

In step 608, the CPU 101 determines whether the value represented by the two-word data is (1,0) or not. When the receiver 107 has received a reproduction command as the music information, the determination becomes YES, and the CPU 101 executes a label 5 process involving reception of the reproduction command in step 609, and then terminates the process. When the sound data and music information other than the reproduction command have been received, the determination becomes NO, and the CPU 101 shifts its control to step 610.

In step 610, the CPU 101 determines whether the value represented by the two-word data is (2,0) or not. If the image data is received as the music information by the receiver 107, the determination becomes YES, and the CPU 101 executes a label 6 process involving the reception of the image data in step 611 and then terminates the process. If otherwise in step 610, that is, if the sound data, reproduction command, and music information other than the image data are received, the determination becomes NO, and the CPU 101 shifts its control to step 612.

In step 612, the CPU 101 determines whether the value represented by the two-word data is (3,0) or not. If the point data is received as the music information by the receiver 107, the determination becomes YES, the CPU 101 executes a label 7 process involving the reception of the reproduction command in step 613 and then terminates the process. If otherwise, that is, if the MIDI data is received as the music information, the determination becomes NO, and the CPU 101 shifts its control to step 614.

In step 614, the CPU 101 stores the MIDI data received as the music information together with the time data in the music data buffer in the RAM 104. Then, the CPU 101 terminates the process.

As described above, in the label 3 process the CPU 101 processes the music information and effects a process involving the reception of the music information, while checking to see whether the timing specified by the time data has come. Various subroutines to be executed in the label 3 process will be described in detail hereinafter.

Figure 7:
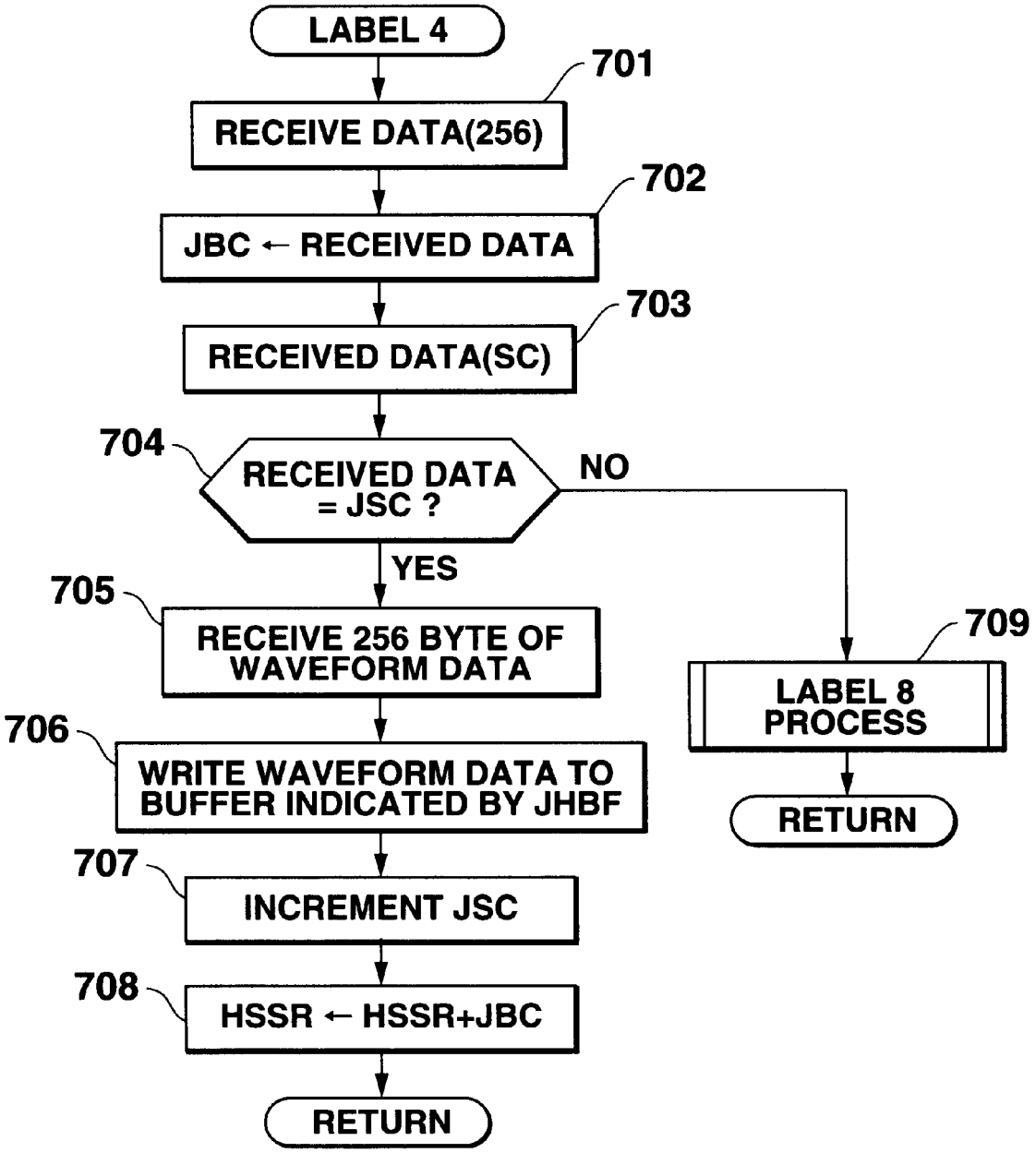
FIG. 7 is a flowchart of a label 4 process.

FIG. 7 is a flowchart of the label 4 process to be executed in step 607. The label 4 process will be described in detail with reference to FIG. 7 hereinafter. The label 4 process involves the reception of music information which contains an identifier for representing sound data, number of bytes of the sound data, serial number, and sound data arranged in this order.

First, in step 701, the CPU 101 fetches the number of bytes positioned next to a constant which is the identifier from among the data received from the receiver 107, and substitutes it into the variable JBC in step 702. Then, the CPU 101 fetches the serial number from the received data in step 703, and shifts its control to step 704, where it determines whether the received serial number is equal to the value of the variable JSC prepared for counting the number of receptions of the sound data. When all the sound data transmitted from the transmission source are normally received, both the values coincide. Thus, the determination becomes YES, and the CPU 101 shifts its control to step 705. If otherwise in step 704, the determination becomes NO, and the CPU 101 shifts its control to step 709.

In step 705, the CPU 101 fetches 256-byte sound data positioned next to the serial number from the received data. In step 706, the CPU 101 stores the sound data in the reception waveform buffer specified by the value of the variable JHBF. Then, the CPU 101 increments the value of the variable JSC in step 707, updates the value of the variable HSSR in step 708, and then terminates the process.

The determination of NO in step 704 means that there is sound data which is not received normally among the sound data transmitted from the transmission source, namely, that an error has occurred in the reception of the sound data. Therefore, the CPU 101 effects a label 8 process in step 709 for coping with the error. Then the CPU 101 terminates the process.

Figure 8:
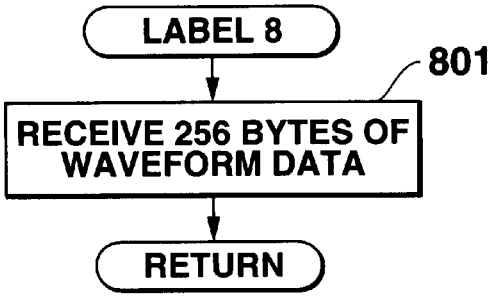
FIG. 8 is a flowchart of a label 8 process.

FIG. 8 is a flowchart of the label 8 process mentioned above.

When an error has occurred in the reception of the sound data, there is a probability that an abnormal sound will be generated due to the error. Therefore, in the label 8 process, the CPU 101 effects a process for abandoning the received sound data in step 801. Then, the CPU 101 terminates the process.

Figure 9:
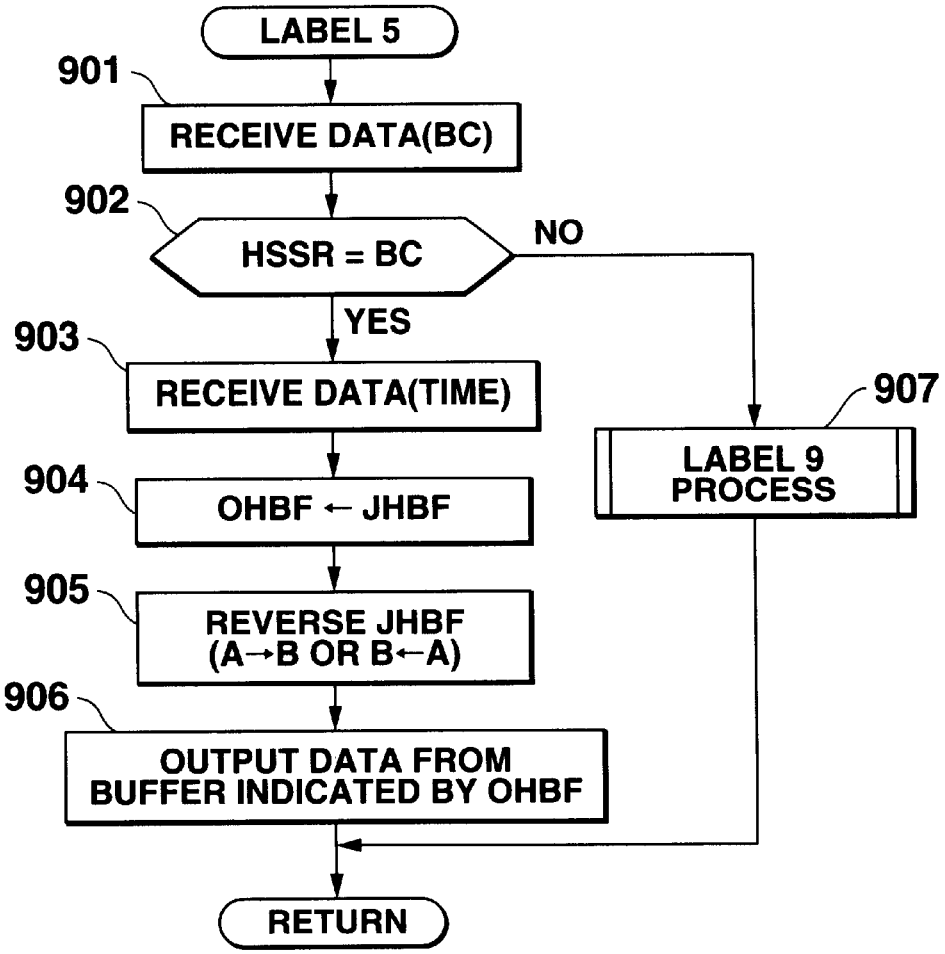
FIG. 9 is a flowchart of a label 5 process.

FIG. 9 is a flowchart of the label 5 process to be executed as step 609 in the music information receiving process. The label 5 process will be described in detail with reference to FIG. 9 hereinafter.

The label 5 process involves the reception of the reproduction command. The transmission source transmits an identifier representing a musical sound reproduction command, a total number of bytes of the sound data transmitted so far and time data, arranged as the music information in this order. The total number of bytes of the music information is represented by the value of the variable BC.

First, in step 901 the CPU 101 fetches the total number of bytes of the music information positioned next to a constant which represents the identifier from among the data received from the receiver 107. In step 902, the CPU 101 determines whether the total number of bytes is equal to a value of the variable HSSR or not. When the value of the variable BC in the transmission source present at transmission of the reproduction command coincides with the value of the variable HSSR, the determination becomes YES, and the CPU 101 shifts its control to step 903. If otherwise in step 902, the determination becomes NO, and the CPU 101 shifts its control to step 907.

In step 903, the CPU 101 fetches the time data positioned next to the total number of bytes from among the received data, and substitutes it into the musical sound generating time register. Then, the CPU 101 shifts its control to step 904.

The sound data transmitted prior to the reproduction command is data representing the sound collected by the microphone 111, and sent to the CPU 101 from the A-to-D converter 112 as requested. Thus, the sound data generally becomes music information of the kind received first by the receiver 107. The sound data is larger in the number of bytes compared to the other data. Therefore, it is expected that the transmission time will fluctuate most. Therefore, in the present embodiment, the time data added to the reproduction command is substituted into the musical sound generating time register. Thus, the performance of the music information received at the reception end is effected, using the reproduction of the waveform data as a reference timing. By substitution of the time data added to the reproduction command into the musical sound generating time register, the timing for processing the MIDI data is specified by merely comparing the time data added to the MIDI data with the value of the musical sound generating time register, as mentioned in step 603 of the label 3 process of FIG. 6.

In step 904, the value of the variable JHBF which represents a reception waveform buffer which has stored the newest received sound data is substituted into a variable OHBF for managing the reception waveform buffer which has stored the sound data to be reproduced. In step 905, the CPU 101 reverses the value of the variable JHBF. For example, if the value of the variable JHBF present so far is A, it is rewritten with B and vice versa. Then, the CPU 101 shifts its control to step 906, and starts reproduction of the sound data stored in the reception waveform buffer specified by the value of the variable OHBF. Then, the CPU 101 terminates the process.

Although not detailed, the CPU 101 reproduces the sound data by sequentially reading out the sound data stored in the reception waveform buffer in units of one sample at the sampling cycle, and delivering them sequentially to the D-to-A converter 109.

As mentioned above, the determination of NO in step 902 means that there is a probability that any error has occurred in the reception of the sound data. Thus, the CPU 101 effects a label 9 process coping with the error in step 907 to stop reproduction of the sound data. Then, the CPU 101 terminates the process.

Figure 10:
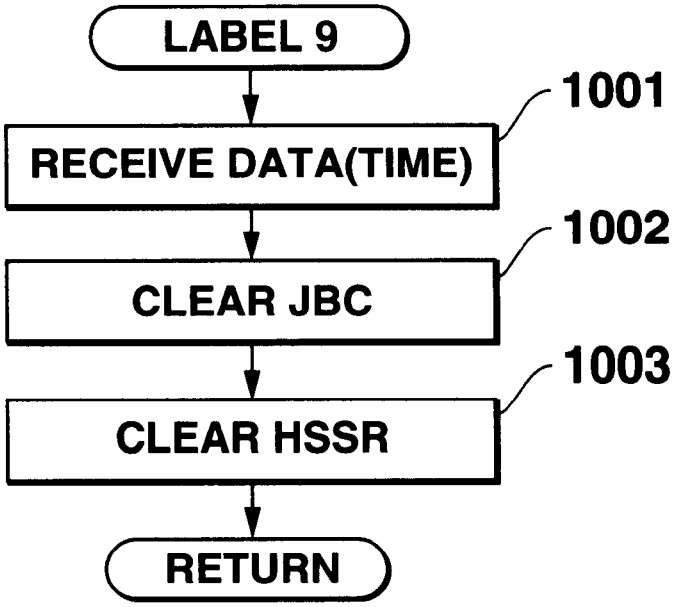
FIG. 10 is a flowchart of a label 9 process.

FIG. 10 is a flowchart of in the label 9 process. In this process, as shown in FIG. 10, the CPU 101 fetches time data contained in the received data in step 1001, and then clears the values of the variables JBC and HSSR to 0 (steps 1002 and 1003). The CPU 101 then terminates the process. By clearing the value of the variable HSSR, the determination in step 902 is always NO thereafter. Thus, the reproduction of the sound data normally received is terminated and not effected any longer. Thus, generation of an abnormal sound due to the occurrence of error is avoided.

Figure 11:
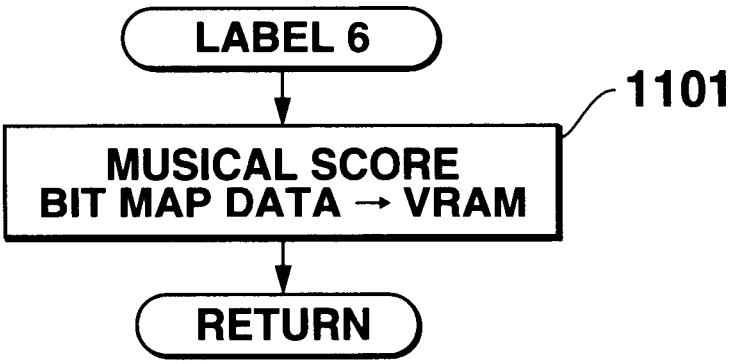
FIG. 11 is a flowchart of a label 6 process.

FIG. 11 is a flowchart of a label 6 process to be executed as step 611 in the label 3 process of FIG. 6. In the label 6 process involving the reception of the image data (assumed as the bit map data of the musical score herein), the CPU 101 fetches image data positioned next to the identifier (2,0) from the received data, and then transfers it to the VRAM provided in the liquid crystal display device 106 in step 1101. Thus, the CPU 101 displays a musical score on the liquid crystal display device 106, and then terminates the process.

Figure 12:
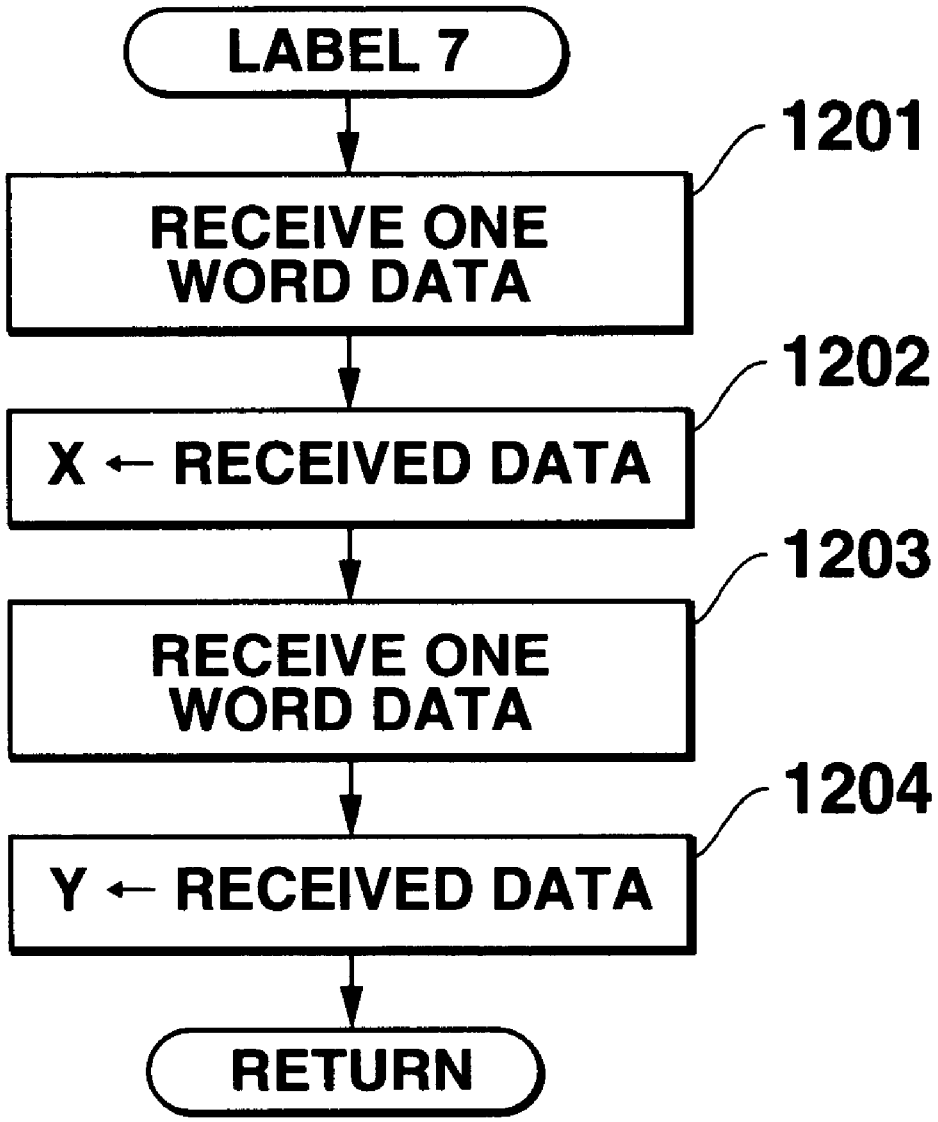
FIG. 12 is a flowchart of a label 7 process.

FIG. 12 is a flowchart of a label 7 process to be executed as step 613 in the label 3 process of FIG. 6. This label 7 process involves reception of point data (which specifies the display position of the cursor indicative of a performance position on the musical score). In this process, the CPU 101 fetches X coordinate data positioned next to the identifier (3,0) from the received data, stores the X coordinate in the cursor X register of the cursor pointer 105 (steps 1201, 1202), similarly fetches Y coordinate data from the received data and stores it in the cursor Y register (steps 1203, 1204). In this way, the CPU 101 changes the display position of the cursor and then terminates the process.

In the first embodiment, it is assumed to transmit and receive five kinds of event data, i.e., MIDI data, sound data, reproduction command, image data, and point data. Of course, the contents of the music information to be transmitted should not be limited to those data. They may be more or less than five, and further the type of transmission of the music information may be changed as requested.

While in the present embodiment the sound data is illustrated as invariably transmitted in a transmission mode, it is not necessarily required to be done so. For example, the sound data may be transmitted as it is or in a compressed state only when the microphone 111 is picking up sounds of a volume level higher than a set volume level. When the transmitting end transmits only sound data worth reproducing at the receiving end or reduces the quantity of the sound data to be transmitted, the transmitting end can transmit a corresponding quantity of music information of other kinds. When an error has occurred in the reception of the sound data, the musical sound may be cross-faded to make the occurring error inconspicuous without muting the musical sound immediately.

While in the first embodiment the transmission and reception of the music information are illustrated, only one of transmission and reception of the music information may be effected. In this case, it is preferable to be able to optionally select the kind of music information to be transmitted/received.

<Second Embodiment>

Recently, sequencers dedicated to automatic performance (including an automatic accompaniment) and other different apparatuses have an automatic performance function. The user can enjoy an ensemble by utilizing such function.

Processing the performance data (sequence data) therefor effects the automatic performance. The performance data is composed of a plurality of pairs of event data representing the contents of an event in the performance (e.g. MIDI data) and time data representing a timing for processing the event data, each pair representing one unit to be processed, arranged in order of processing. Thus, it is possible to inhibit performance of a part selected from among performance data, but it is impossible to add an external additional part to the original performance data and then to perform the resulting performance data. Under the circumstances, the second embodiment enables the contents of musical data automatically performable to be added to the performance data.

To this end, the second embodiment comprises a combination of the music information editing apparatus having the function of adding the contents of the automatic performance and the music information receiving apparatus of the first embodiment. The second embodiment has substantially the same in composition as the first embodiment (FIG. 1). Therefore, the second embodiment will be described next, using the reference numerals of the first embodiment used with reference to FIG. 1.

Figure 13:
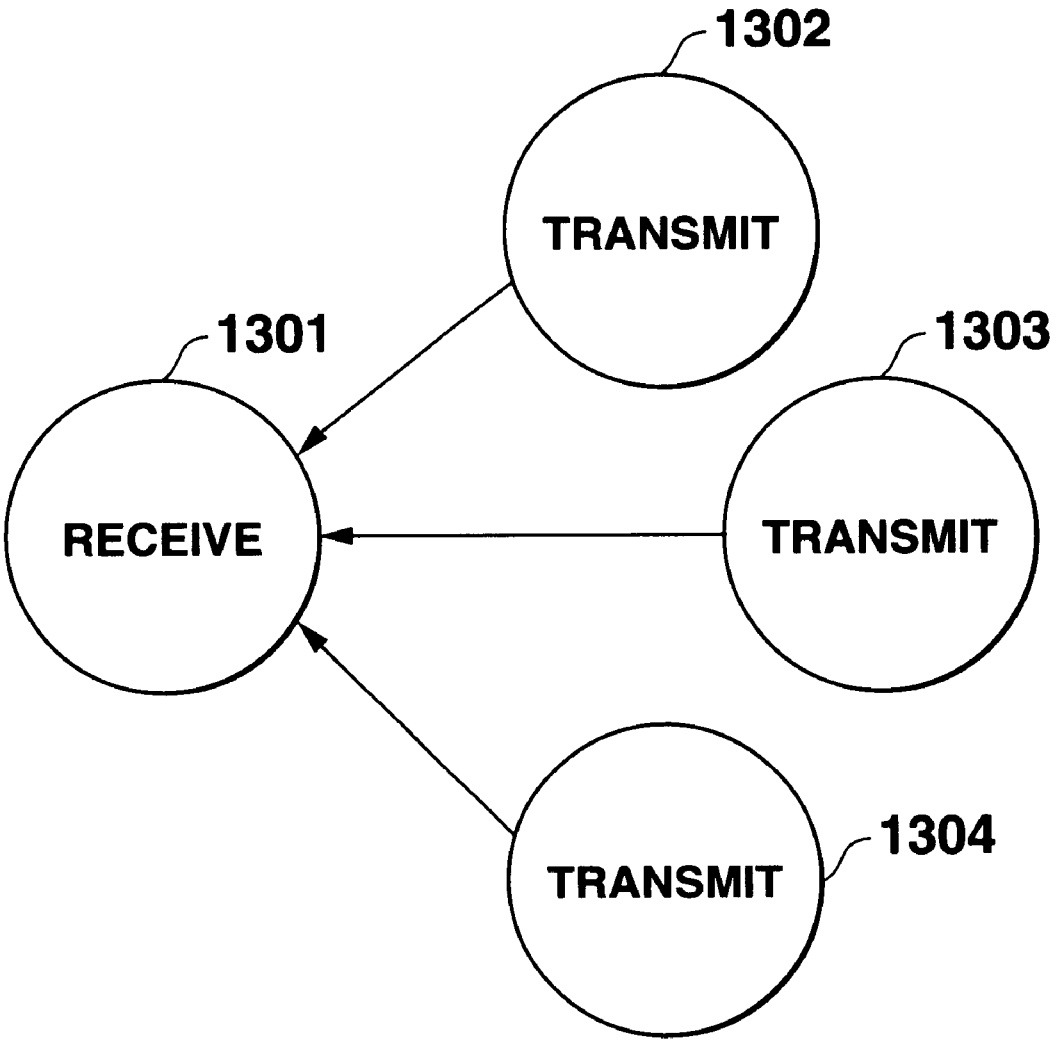
FIG. 13 illustrates a method of utilizing a musical sound generating apparatus, which includes a music information transmitting-receiving apparatus as a second embodiment of the present invention.

FIG. 13 illustrates a method of utilizing a musical sound generating apparatus which includes the music information transmitting-receiving apparatus of the second embodiment. The method will be described next along with operation of the musical sound generating apparatus with respect to FIG. 13.

In FIG. 13, musical sound generating apparatus 1301 to 1304 each have the structure of FIG. 1. FIG. 13 shows that by arrows each of musical sound generating apparatuses 1302 to 1304 transmits music information to a musical sound generating apparatus 1301.

Each of the musical sound generating apparatuses 1302 to 1304 transmits performance data selected with the switch group 115 to a destination device specified by the switch group 115. To this end, the CPU 101 reads out selected performance data from the ROM 103 and delivers it to the transmitter 108.

The performance data transmitted from those apparatuses 1302 to 1304 are received by the musical sound generating apparatus 1301. The CPU 101 of the apparatus 1301 stores the performance data received by the receiver 107 in an area of the RAM 104 thereof (for convenience's sake, hereinafter referred to as a music data buffer). In the present embodiment, the reception of the performance data is effected by each of the apparatuses 1302 to 1304 in a handshaking fashion.

When the reception of the performance data from each of the apparatuses 1302 to 1304 is completed, the CPU 101 of the apparatus 1301 sorts event data (in this case, MIDI data) in the order of their earlier performance timings specified by time data added to the event data. That is, the pairs of event data and time data are rearranged in order of processing. After this, the reproduction of the performance data is started.

This method of managing the timings based on the time data is mainly classified into two: that is, an absolute time series managing method of representing the timing with a time lapsing from a time of reference, and a relative time series managing method of representing the timing with a time lapsing from occurrence of a last event. The former method is employed in the present embodiment.

As mentioned above, since the event data are sorted on the basis of time data, the timings for processing event data composing respective performance data are maintained while the performance data are arranged as one unit in an appropriate form. Thus, the user can optionally combine different performance data and appropriately reproduce the respective performance data. Thus, the user can expand a range of musical expression, which the user can use and enjoy music in diverse manners, thereby improving facilities provided for the user. Moreover, since the performance data can be stored in a divided state, it is avoided that all of the performance data will be stolen or deleted at a time, thereby increasing security.

While in the present embodiment the performance data to be combined with are illustrated as being received from the external devices, they may be obtained in another way. They may be obtained by accessing a recording medium such as a floppy disk, a CD-ROM or an IC card. Of course, it is also possible to select a plurality of performance data stored in the ROM 103 or recording medium and to combine the selected performance data.

Referring now to FIGS. 14 to 19, the operation of the CPU 101 which provides the control mentioned above will be described next in detail with respect to transmission, reception and edition of music information for the sake of easy understanding.

Figure 14:
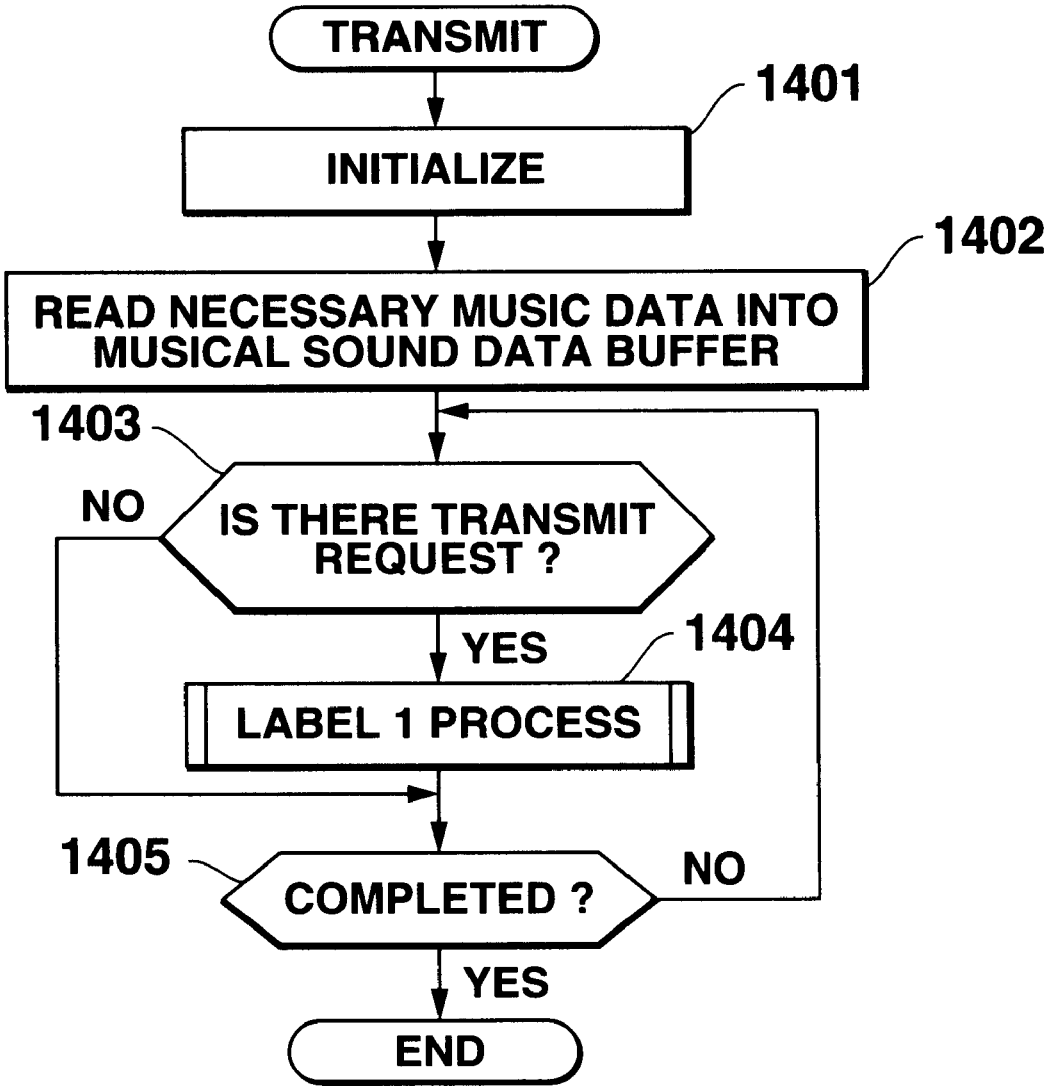
FIG. 14 is a flowchart of a music information transmitting process effected in the second embodiment.
Figure 15:
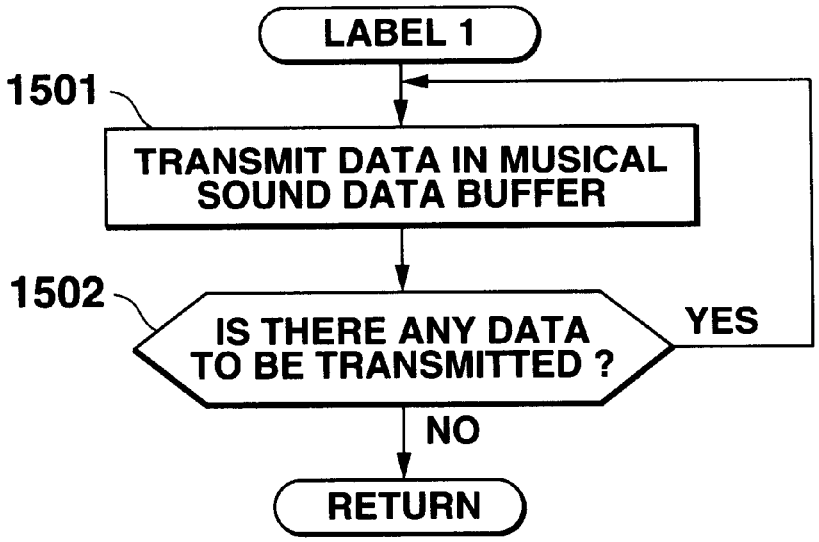
FIG. 15 is a flowchart of a label 1 process in the second embodiment.

FIG. 14 is a flowchart of a music information transmitting process, which handles transmission of music information (i.e. performance data). Referring to FIGS. 14 and 15, the operation of the CPU 101 in the transmission of the performance data will be described in detail hereinafter.

The process of FIG. 14 (including its subroutine process FIG. 15) starts when the user specifies with the switch group 115 performance data to be transmitted and hence the CPU 101 executes a corresponding program stored in the ROM 103.

First, in step 1401, the CPU 101 effects initialization for providing a music data buffer in the RAM 104. In step 1402, the CPU 101 reads out the performance data specified by the user from the ROM 103 and stores it in the buffer. Then, the CPU 101 shifts its control to step 1403.

In the present embodiment, the performance data supposed to be edited is not transmitted to a destination device until the destination device requests transmission of the performance data. Therefore, in step 1403, the CPU 101 determines whether the request has been received or not. If received, the determination becomes YES, and the CPU 101 effects the label 1 process which includes transmitting the performance data in step 1404, and then shifts its control to step 1405. If otherwise in step 1403, the determination becomes NO, the CPU 101 thereby shifts its control to step 1405.

In step 1405, the CPU 101 determines whether the transmission of the performance data has been completed. If all the required performance data have been transmitted to the receiver or the transmission of the performance data has been stopped by the user's instruction with the switch group 115, the determination becomes YES, and the CPU 101 terminates the process. If otherwise in step 1405, the determination becomes NO, and the CPU 101 returns its control to step 1403, where it determines whether it is necessary to continue transmission of the performance data. Thus, all of the performance data to be transmitted is transmitted to all of the destination devices.

FIG. 15 is a flowchart of the label 1 process to be executed in step 1404. In this process, the CPU 101 first transmits the performance data stored in the music data buffer in step 1501. In step 1502, the CPU 101 determines whether there is still any data to be transmitted in the buffer or not. If all of the data have been transmitted, the determination becomes NO. Then, the CPU 101 transmits to the destination device a message that all of the data have been transmitted, and then terminates the process. If there is in step 1502, the determination becomes YES, and the CPU returns its control to step 1501, where it transmits to the destination devices the data, which is not transmitted yet.

As mentioned above, in the label 1 process, the steps 1501 and 1502 compose a processing loop, whose looping operation is repeatedly executed as long as untransmitted data exists to thereby to transmit the performance data in units of a predetermined quantity. In this case, the CPU 101 adds a header to the data read out from the music data buffer and sends resulting data to the transmitter 108.

Figure 16:
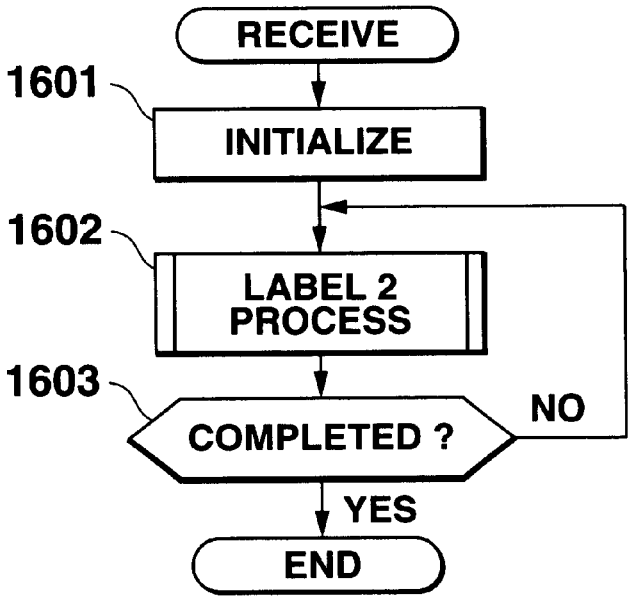
FIG. 16 is a flowchart of a music information receiving process in the second embodiment.

FIG. 16 is a flowchart of a music information receiving process. Referring now to FIGS. 16 to 19, the controlling operation of the CPU 101 for the reception of the performance data will be described in detail.

The user receives performance data from a transmission source specified with the switch group 115. The music information receiving process is executed in such a manner that if the reception of the performance data is specified by the user with the switch group 115 after the transmission source is specified, the CPU 101 executes a corresponding program stored in the ROM 103.

First, in step 1601, the CPU 101 performs initialization for preparing the reception of the performance data. Thus, the CPU 101 clears the value of a variable SAR for managing a transmission source of the performance data or substitutes zero into the variable SAR, and provides an area for storing the received performance data. Then, the CPU 101 shifts its control to step 1602. The area is hereinafter referred to as a received music data buffer for convenience's sake.

In step 1602, the CPU 101 effects the label 2 process for requesting transmission of the performance data from the transmission source and for receiving the performance data. In step 1603, the CPU 101 determines whether the processing of the performance data has all been completed or not. The received performance data is edited and then reproduced. Therefore, when the reproduction is completed or the user stops its reproduction with the switch group 115, the determination becomes YES, and the CPU 101 terminates the process. If otherwise in step 1403, the determination becomes NO, and the CPU 101 returns its control to step 1602, where it executes the label 2 process.

Figure 17:
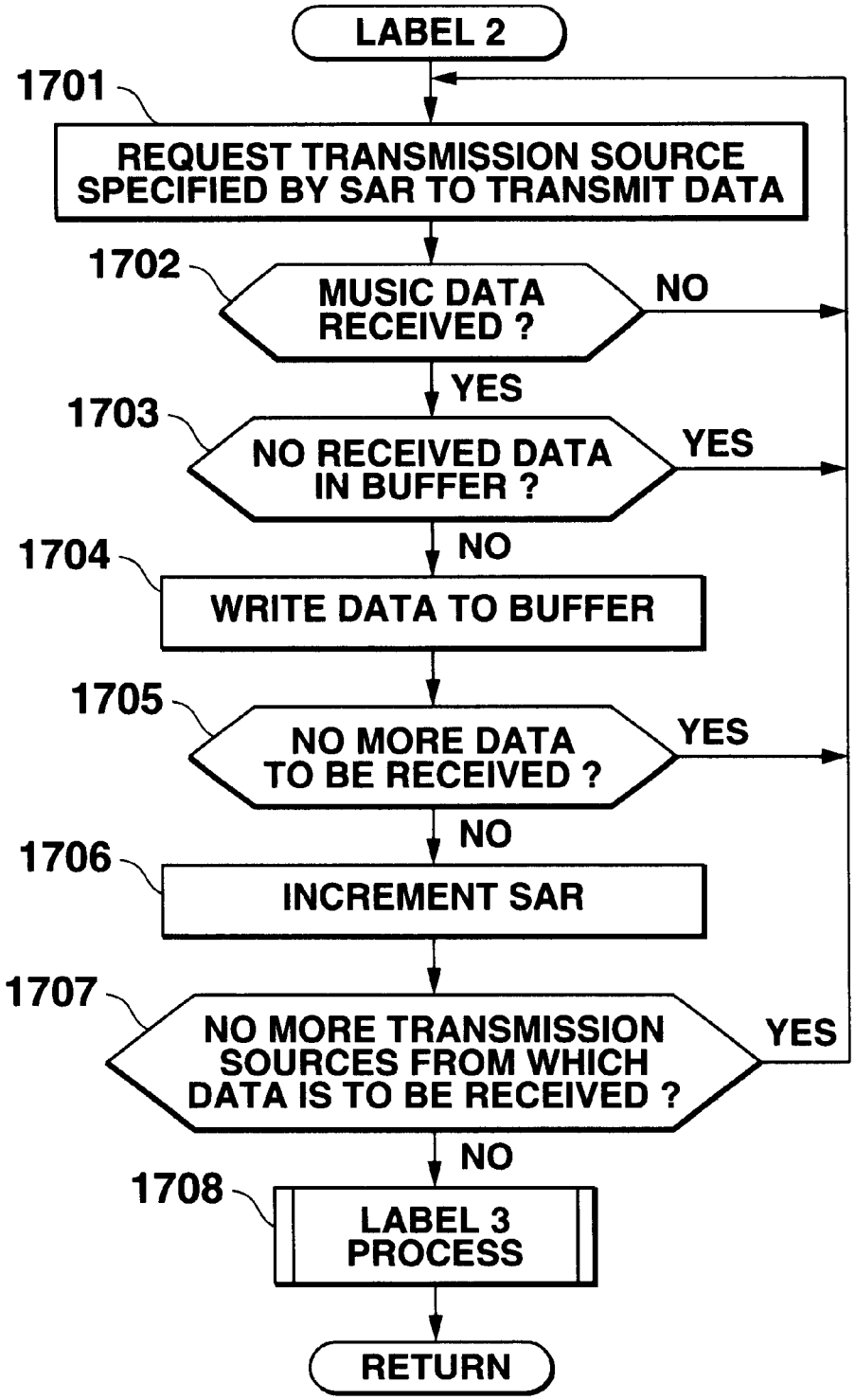
FIG. 17 is a flowchart of a label 2 process in the second embodiment.

FIG. 17 is a flowchart of the label 2 process to be executed in step 1602. Referring now to FIG. 17, the label 2 process will be described in detail hereinafter.

It is possible to specify a plurality of performance data transmission sources. When the CPU 101 has stored data on the transmission sources (addresses) inputted by the user with the switch group 115 in the RAM 104, it receives performance data by selecting the transmission sources sequentially while referring to the stored data. The variable SAR is used for selecting such a transmission source for the performance data.

First, in step 1701, the CPU 101 requests transmission of the performance data from the transmission source specified by the value of the variable SAR. In step 1702, the CPU 101 inquires the sever through the receiver 107 of whether the performance data has been transmitted. If the transmission source has transmitted the performance data, the determination becomes YES, and the CPU 101 shifts its control to step 1703. If otherwise in step 1702, the determination becomes NO, and the CPU 101 returns its control to step 1701. Then, the CPU 101 waits the transmission of the performance data in step 1702.

In step 1703, the CPU 101 determines whether performance data has been received from the server through the receiver 107, and whether the same performance data as the received one is stored in the reception music data buffer. If the MIDI data of the received performance data and the time data added to the MIDI data do not coincide with those of the performance data stored in the reception music data buffer, the determination becomes NO, the CPU 101 stores the performance data received in step 1704 and then shifts its control to step 1705. If otherwise in step 1703, the determination becomes NO, the CPU 101 requests the transmission of the performance data from the sever.

In step 1705, the CPU 101 determines whether there is any more data to be received. If the received data contains an identifier representing completion of the transmission of the performance data, the determination becomes NO, the CPU 101 increments the value of the variable SAR in step 1706 and then shifts its control to step 1707. If there is in step 1705, the determination becomes YES, and the CPU 101 returns its control to step 1701.

In step 1707, the CPU 101 determines whether there are any more transmission sources from which performance data should be received. If there is a transmission source corresponding to the value of the variable SRA, the determination becomes NO, and the CPU 101 shifts its control to step 1708. If so in step 1707, the determination becomes YES, and the CPU 101 returns its control to step 1701.

The determination of NO in step 1707 means completion of the reception of the performance data from all of the transmission sources specified by the user. Thus, in step 1708 the CPU 101 executes the label 3 process for editing and producing the received performance data. Then, the CPU 101 terminates the process.

Figure 18:
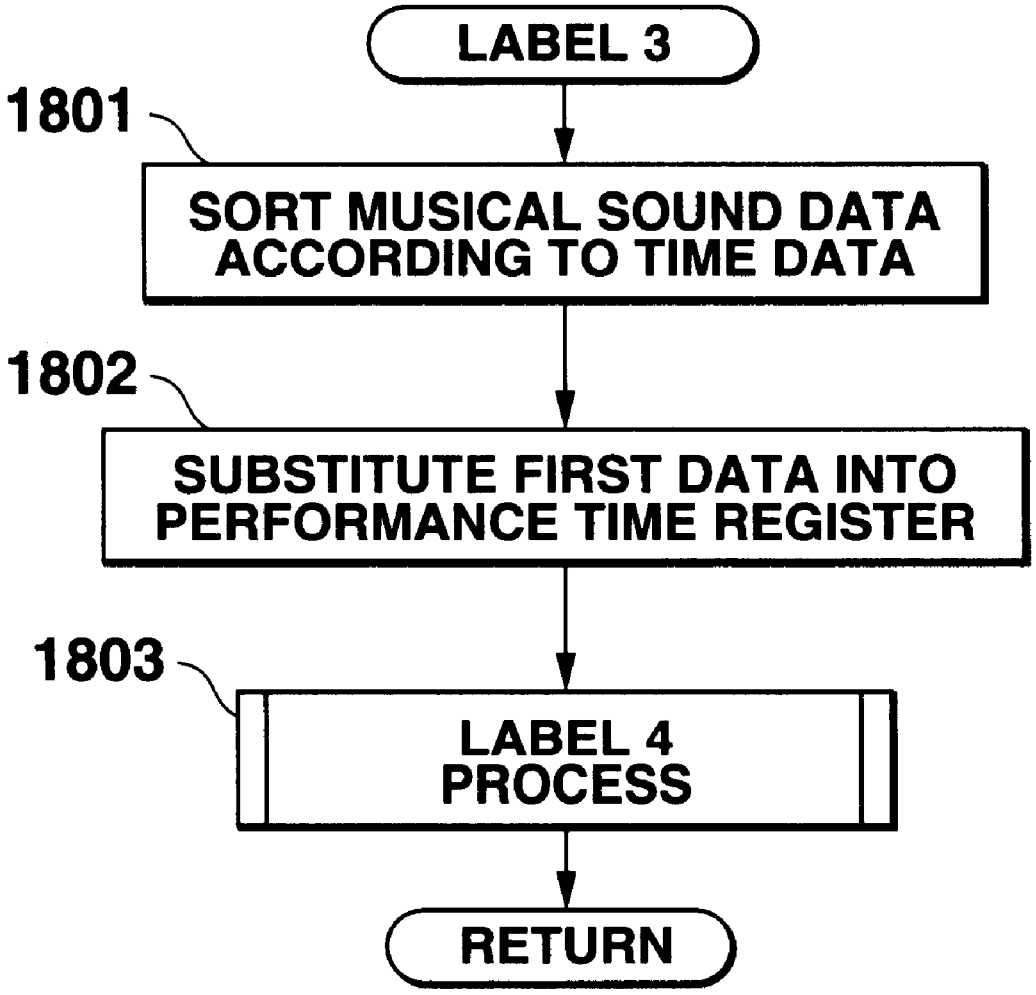
FIG. 18 is a flowchart of a label 3 process in the second embodiment.

FIG. 18 is a flowchart of the label 3 process to be executed in step 1708. Referring now to FIG. 18, the label 3 process will be described in detail hereinafter.

In the execution of the label 3 process, the received performance data are stored in correspondence to the respective transmission sources in the reception music data buffer. The label 3 process is effected on those performance data.

First, in step 1801, the CPU 101 refers to the time data added to the MIDI data, fetches timing data to process MIDI data from the respective performance data and arranges them in the order of their earlier performance timings to thereby collect the plurality of performance data as one unit while maintaining the processing timings of the MIDI data.

In step 1802, the CPU 101 substitutes time data representing the earliest timing to be specified among the time data into the performance time register. In other words, the CPU 101 substitutes the time data added to the MIDI data to be processed first into the performance time register. The performance time register is a variable used for processing the MIDI data in accordance with the time data, and the value of the performance time register is incremented each time one millisecond lapses, for example, by referring to the timer 102.

Step 1802 includes initialization for starting reproduction of the performance data. In step 1803, the CPU 101 effects the label 4 process for reproducing the performance data. The series of steps composing the label 3 process is completed after the completion of the label 4 process.

Figure 19:
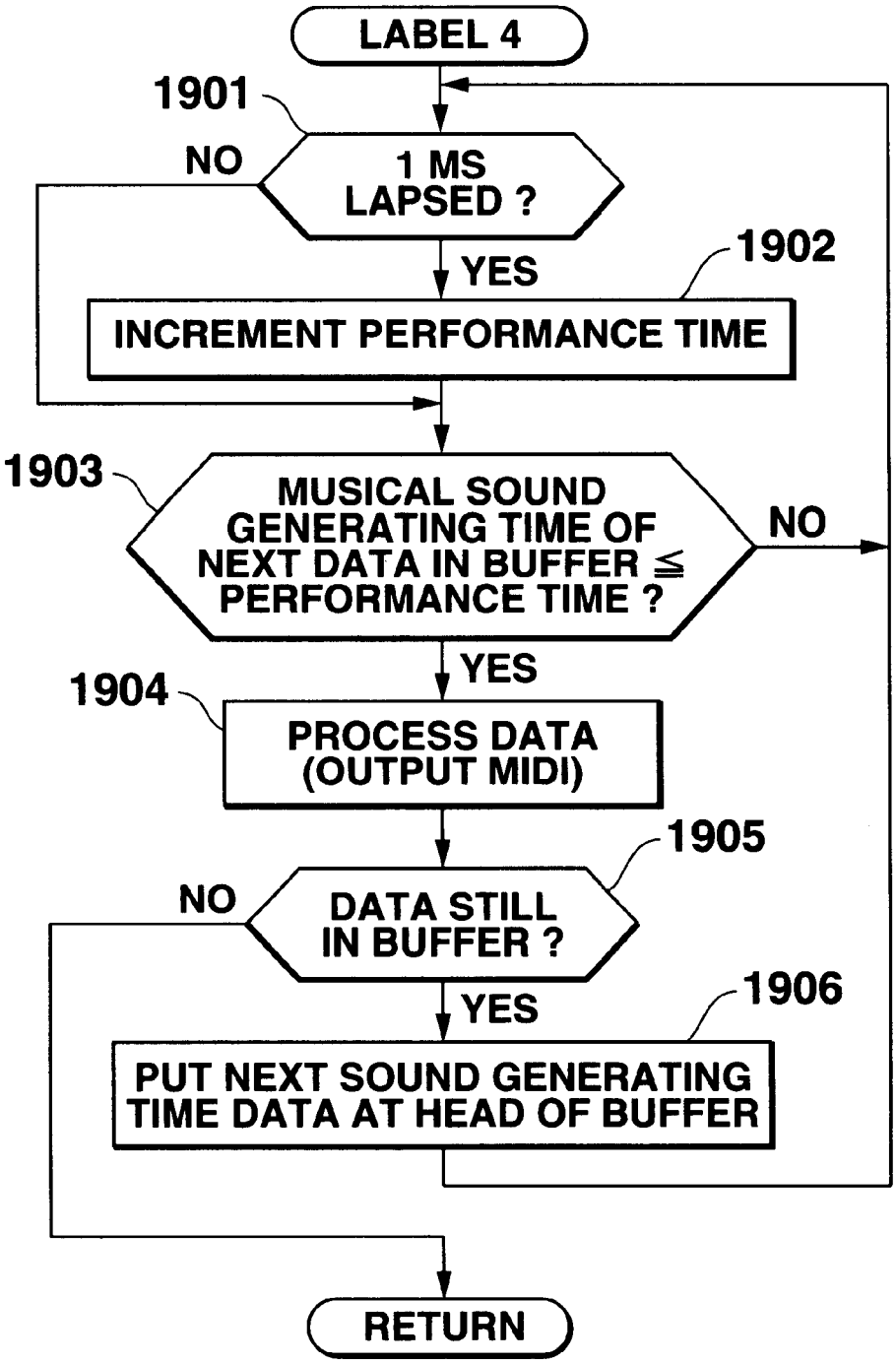
FIG. 19 is a flowchart of a label 4 process in the second embodiment.

FIG. 19 is a flowchart of the label 4 process executed in step 1803. This process will be described in detail hereinafter, which is executed on the performance data after edition.

First, in step 1901, the CPU 101 determines whether one millisecond has lapsed since the value of the performance time register was updated last. If there is a difference of a value corresponding to at least one millisecond between the value of the timer 102 at the time when the value of the performance time register was updated last and the present value of the timer 102, the determination becomes YES. Thus, the CPU 101 increments the value of the timer in step 1902 and then shifts its control to step 1903. If otherwise in step 1901, the determination becomes NO, and the CPU 101 shifts its control to step 1903.

In the 1903, the CPU 101 determines whether a timing for processing next MIDI data selected from among the performance data has come. When the value of the time data added to the MID data is not more than the value of the performance time register, the determination becomes YES. The CPU 101 then processes the MIDI data in step 1904 and shifts its control to step 1905. If otherwise in step 1903, the determination becomes NO, and the CPU 101 returns its control to step 1901. The processing of the MIDI data is executed after transmission of the MIDI data by the CPU 101 to the MIDI OUT terminal 113.

In step 1905, the CPU 101 determines whether there is unprocessed MIDI data among the performance data or not. Where all of the MIDI data are not processed, the determination becomes YES. The CPU 101 selects the MIDI data to be processed next in step 1906, and then returns its control to step 1901. If otherwise, namely, when the reproduction of the performance data is completed, the determination becomes NO, and the CPU 101 then terminates the process. The selection of the data to be processed next is executed, for example, by substituting the value of an address at which the MIDI data to be processed next is stored into the variable for managing the MIDI data to be processed.

As mentioned above, the label 4 process is executed in such a manner that the value of the performance time register is updated as required and that the MIDI data is processed at the timing specified by the time data.

While in the second embodiment the edition which collects a plurality of performance data as one unit is illustrated, the present invention is not limited to this particular case. For example, instead of the edition, each time one item of MIDI data is processed, another item of MIDI data to be processed next may be searched from among the plurality of performance data. However, if this process is used when the relative time series managing method is employed, a complex operation to specify the timing must be effected in parallel with reproduction of the performance data. Thus, after the edition, the performance data is preferably produced.

While in the second embodiment performance data including the MIDI data is illustrated as being edited, it may be data other than the MIDI data, for example, sound data. The performance data is beforehand stored in the transmission source. Music information to be produced and transmitted as requested may be an object to be edited when each transmission source has beforehand determined as a reference a time for time counting, for example, by adding to the performance data time data representing a time when the performance is started.

While the respective users of the devices 1302–1304 are illustrated as specifying performance data to be transmitted, the devices, which request transmission of the performance data, may specify the performance data.

In addition, while in the present embodiment the received performance data is illustrated as being edited, performance data stored in a recording medium may be edited instead. As will be obvious from this, the music information editing device may be provided on apparatus which are capable of receiving music information as well as on various other devices.

<Third Embodiment>

Since the MIDI have spread and music information can be easily transmitted and received, a range of use of the devices has spread, for example, such that they are used in respective specified applications. Thus, it has so widely spread that a user combines a plurality of devices into a single system suitable for the user to enjoy music. The third embodiment is intended to increase a range of use of the devices by paying attention to a possibility of new music being created based on transmission and reception of music information.

The musical sound generator which includes a music information transmitting/receiving apparatus of the third embodiment is basically the same in composition as the first embodiment (FIG. 1). Thus, the third embodiment will be described by basically using the reference numerals used for explaining the first embodiment with reference to FIG. 1.

Figure 20:
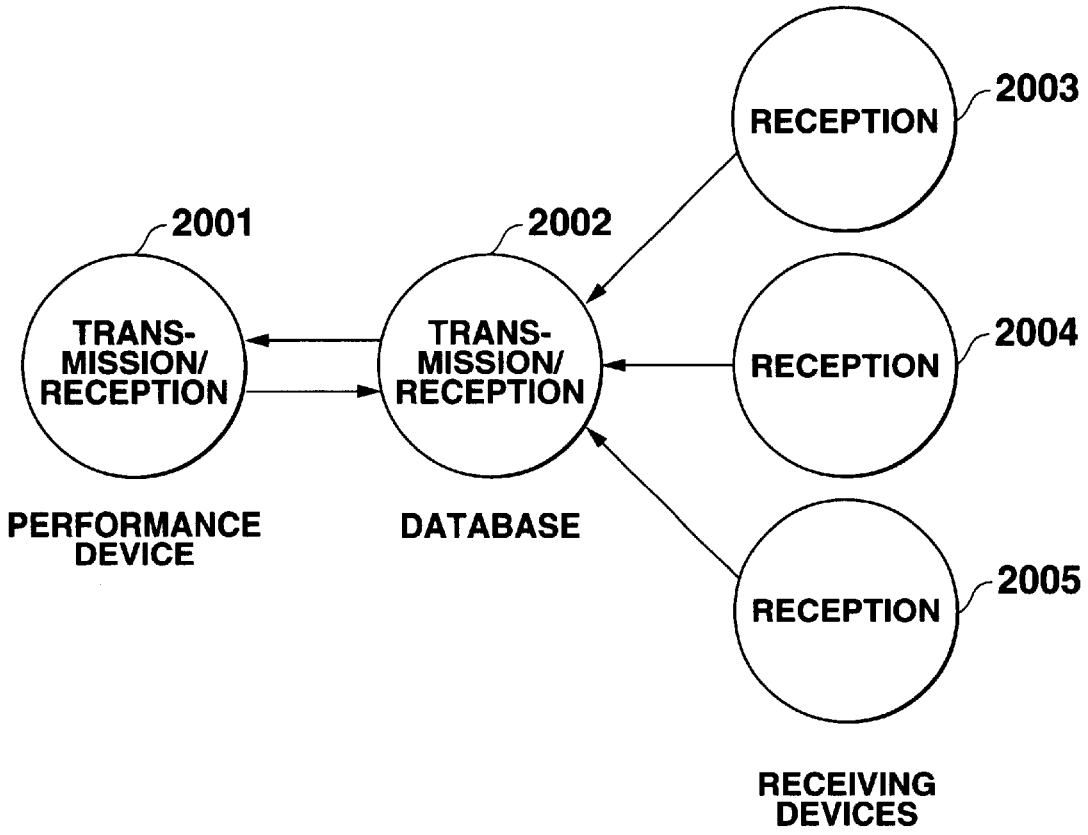
FIG. 20 illustrates a method of utilizing a musical sound generating apparatus which includes a music information transmitting-receiving apparatus as a third embodiment of the present invention.

FIG. 20 illustrates a method of using the musical sound generator and its operation therefor. Reference numerals 2001–2005 of FIG. 20 each denote the musical sound generator, for example, having the composition of FIG. 1. The musical sound generator 2001 transmits/receives music information to/from the musical sound generator 2002, which in turn transmits music information to the musical sound generators 2003–2005. As in the first and second embodiments, the generators 2001–2005 are connected via a LAN.

In the system of FIG. 20, the musical sound generator 2001 is supposed to be used for performance. The musical sound generator 2002 is supposed to provide music information for the musical sound generators 2001, and 2003–2005. The musical sound generators 2003–2005 are supposed to reproduce received music information. Thus, for convenience's sake, the musical sound generator 2001 is hereinafter referred to as a performance device, the musical sound generator 2002 as a database, and the musical sound generators 2003–2005 as receiving devices.

The devices 2001–2005, which compose the system of FIG. 20, operate as follows. The respective devices 2001–2005 are operated, for example, when the users operate respective switch groups 115 to set the devices in the corresponding modes. For example, when a mode is set which specifies that the device 2002 should operate as a database, and the user at the device 2002 specifies with the switch group 115 the device 2001 as the performance device and the devices 2003–2005 as receiving devices, those devices are connected so as to fulfill their respective specified functions. The database 2002 reads out from the ROM 103 performance data which the user specified with the switch group 115, and provides the performance data as music information for the respective devices 2001 and 2003–2005 as follows.

The database 2002 refers to time data added to the MIDI data which composes a portion of the performance data, and transmits the MIDI data along with the time data at a timing specified by the time data to the performance device 2001 as required.

The performance device 2001 receives the performance data from the database and processes the MIDI data based on the time data to thereby reproduce the performance data. The performance device 2001 transmits to the database 2002 the contents of an ensemble, which the user effected, based on the reproduction of the performance data. More specifically, the performance device 2001 adds time data to MIDI data indicative of the contents of the user's manipulation effected on the keyboard 130, and then transmits resulting data to the database 2002. The time data is produced based on the time data received from the database 2002.

In the present embodiment, the performance device 2001 transmits only the contents of the performance, which the user effected because the performance data received by the performance device 2001 is possessed by the database 2002. This avoids possible occurrence of something wrong with the database 2002 when the performance device 2001 does not transmit the performance data to the database. By sending back to the database 2002 no performance data received from the database, as described above, a quantity of data communicated between the database 2002 and the performance device 2001 is reduced as a whole to thereby improve the efficiency of use of a transmission path which connects those devices.

The database 2002 transmits to the respective receiving devices 2003–2005 the same performance data as was transmitted to the performance device 2001, and the performance data received from the performance device 2001. This transmission is effected based on the time data received from the performance device 2001 because the data transmission between the performance data 2001 and the database 2002 takes some time to thereby avoid occurrence of a possible discrepancy between the timings when those performance data are reproduced.

Like the performance device 2001, the respective receiving devices 2003–2005 receive the performance data and process the MIDI data based on the time data to reproduce an ensemble composed of a performance based on reproduction of the performance data which the database 2002 itself has and the performance effected by the user at the keyboard 130 of the performance device 2001.

As described above, the database 2002 is capable of transmitting performance data (music information) having different contents to the respective destination devices. This means that different roles can be easily assigned to the respective destination devices and/or the contents of their roles can easily specified more minutely. Thus, the respective uses of those devices can be set minutely, for example, such that some of the devices should be used for performance, and the other devices should be used for producing different musical sounds, respectively. Thus, those devices become usable selectively for more various purposes to improve their facilities, and the user can use those devices which compose the system in the respective more desired forms. The improvement of their facilities serves to expand the user's musical expression and hence contributes to creation of new music.

A control operation of the CPU 101 of each of the devices 2001–2005 for realizing their respective intended operations will be described in detail with reference to FIGS. 21–26.

Figure 21:
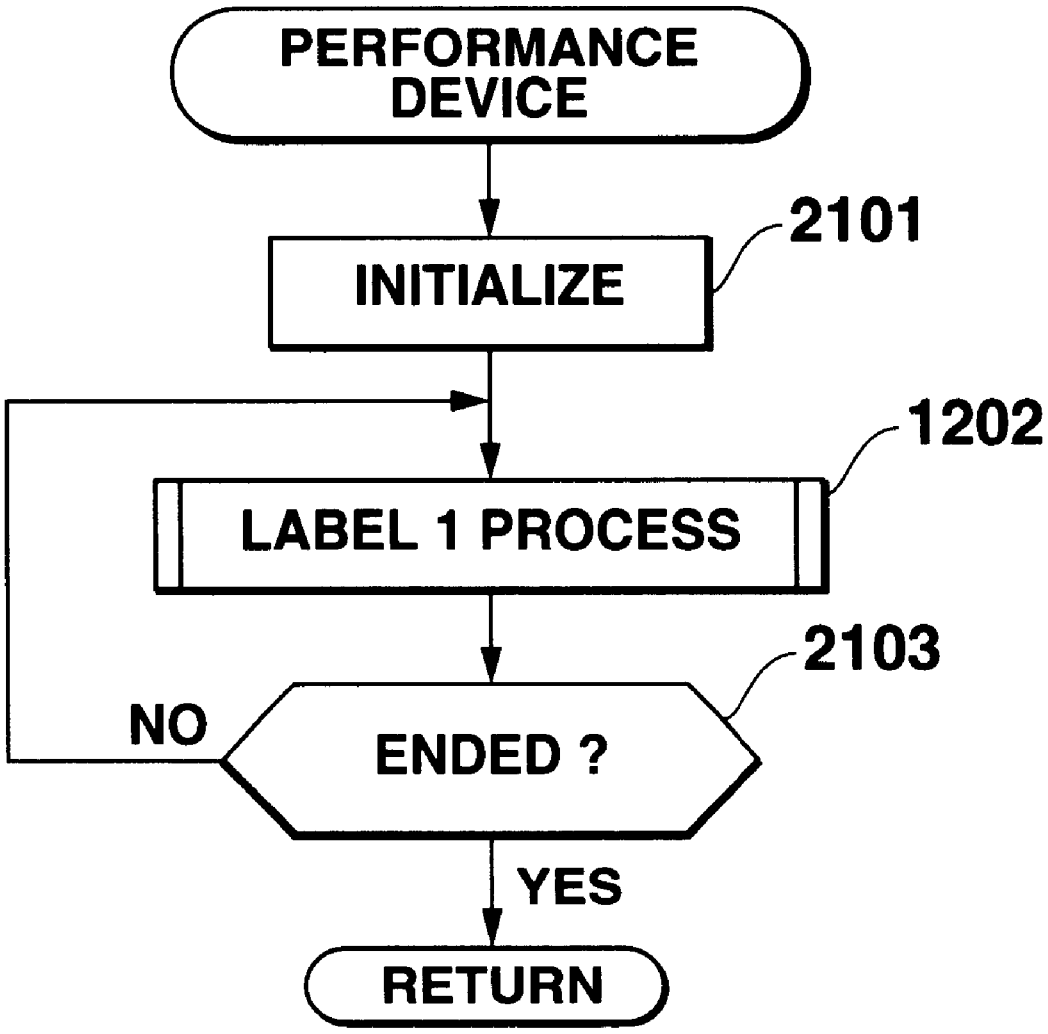
FIG. 21 is a flowchart of the music information transmitting-receiving process effected by a performing device in the third embodiment.

FIG. 21 is a flowchart of a music information transmitting/receiving process effected by the CPU 101 of the performance device 2001. Referring to FIG. 21, the operation of the CPU 101 will be described first in detail. When the user specifies with the switch group 115 that the musical sound generator should function as the performance device, the CPU 101 executes a program stored in the ROM 103 to effect the music information transmitting/receiving process.

First in step 2101, the CPU 101 effects initialization to thereby clear various variables, substitute preset values into required variables, and provide in the RAM 104 an area which temporarily stores the received performance data (hereinafter referred to as a received music data buffer). Then, in step 2102, the CPU 101 effects the label 1 process to transmit/receive music information (here, performance data transmitted/received in units of MIDI data) to and from the database 2002.

The CPU 101 then shifts its control to step 2103, where it determines whether transmission/reception of the music information has been completed. For example, when no performance data has been transmitted for more than a preset time from the database 2002 or when the user instructs the performance device 2001 to stop transmission/reception of the performance data with the switch group 115, the determination in step 2103 becomes YES, and the CPU 101 then terminates the process. If otherwise in step 2103, determination becomes NO and the CPU 101 returns its control to step 2102, where it performs the label 1 process again.

The steps 2102 and 2103 form a processing loop whose looping operation continues until the determination in step 2103 becomes YES. Thus, the CPU 101 effects an automatic performance which includes sequentially receiving and processing MIDI data from the database 2002, and transmits to database 2002 the contents of the performance, which was effected by the user's manipulation on the keyboard 130, in the form of MIDI data.

Figure 22:
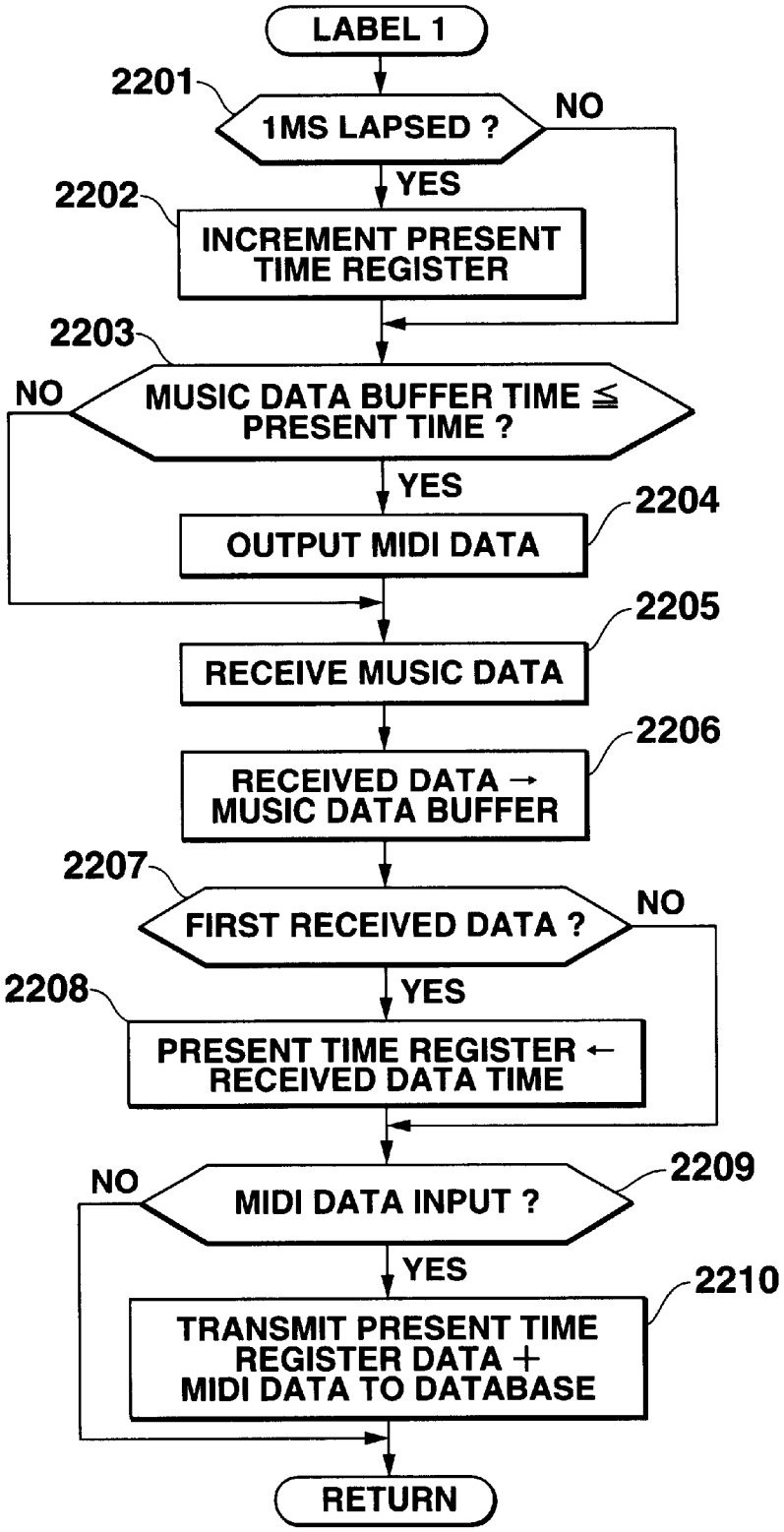
FIG. 22 is a flowchart of a label 1 process in the third embodiment.

FIG. 22 is a flowchart of the label 1 process effected in step 2102, which will be described next. The database 2002 adds time data to the MIDI data and transmits the resulting data to the performance device 2001. In order to process the MIDI data at a timing specified by the time data, a variable (present time register) which updates its value as each predetermined time lapses is prepared, and the value of the variable is compared with the value of the time data.

First, in step 2201, the CPU 101 determines whether one millisecond has lapsed since the value of the present time register was updated last. When there is a difference of a value corresponding to at least one millisecond between the preceding updated value of the timer 102 and the present value of the timer 102, the determination becomes YES. Thus, the CPU 101 increments the value of the present time register in step 2202 and then shifts its control to step 2203. If otherwise in step 2202, the determination becomes NO and the CPU 101 shifts its control to step 2203.

In step 2203, the CPU 101 determines whether a timing at which next MIDI data is to be processed among the MIDI data stored in the received music data buffer has come. When the value of the time data added to this MIDI data becomes smaller than the value of the present time register, the determination becomes YES. Thus, the CPU 101 outputs the MIDI data to the MIDI OUT terminal 113 in step 2204, and then shifts its control to step 2205. If otherwise in step 2203, the determination becomes NO, and the CPU 101 shifts its control to step 2205.

In step 2205, the CPU 101 inquires the sever through the receiver 101 of whether there is any new received data for the CPU 101. If there is, it downloads the data. In step 2206, the CPU 101 stores the MIDI data and time data of the data received from the receiver 107 in the received music data buffer.

The CPU 101 then shifts its control to step 2207, where it determines whether the MIDI data received in step 2005 is first data received as music information from the database 2002. When the database 2002 has transmitted the MIDI data positioned at the head of the performance data, the determination becomes YES. Thus, the CPU 101 substitutes into the present time register the time data added to the MIDI data in step 2208, and then shifts its control to step 2209. If otherwise in step 2207, the determination becomes NO, and the CPU 101 directly shifts its control to step 2209.

As described above, the performance device 2001 substitutes into the present time register the time data received first from the database 2002. Thus, only by comparing the value of the time data added to the received MIDI data with the value of the present time register, the performance device 2001 is capable of processing the MIDI data at the timing specified by the time data.

In step 2209, the CPU 101 determines whether the MIDI IN terminal 114 has received the MIDI data from the keyboard 130. When the user has manipulated the keyboard 130, the determination becomes YES, and the CPU 101 then shifts its control to step 2210. If otherwise in step 2209, the determination becomes NO, and the CPU 101 then terminates the process.

In step 2210, the CPU 101 receives the MIDI data received by the MIDI IN terminal 114, delivers it to the MIDI OUTPUT terminal 113 to cause the sound source 120 to process it, adds the value of the present time register as time data to the MIDI data, delivers the resulting data to the transmitter 108, causes the transmitter 108 to transmit the data to the database 2002, and then terminates the process.

As described above, the performance device 2001 processes the performance data received from the database 2002 and transmits the performance data to the device 2002 and thus the above mentioned operations are effected.

Figure 23:
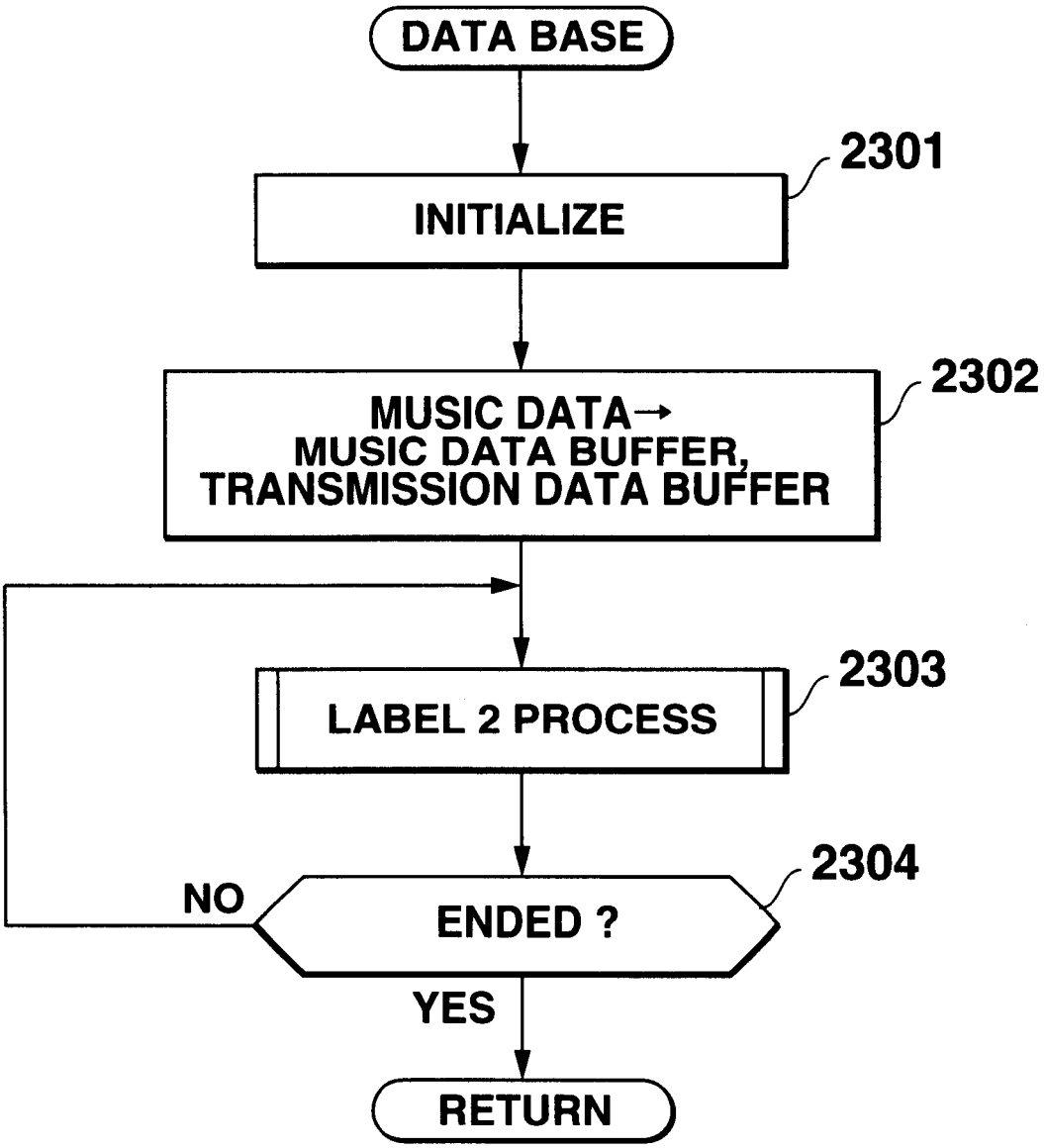
FIG. 23 is a flowchart of a music information transmitting-receiving process effected by a database device in the third embodiment.
Figure 24:
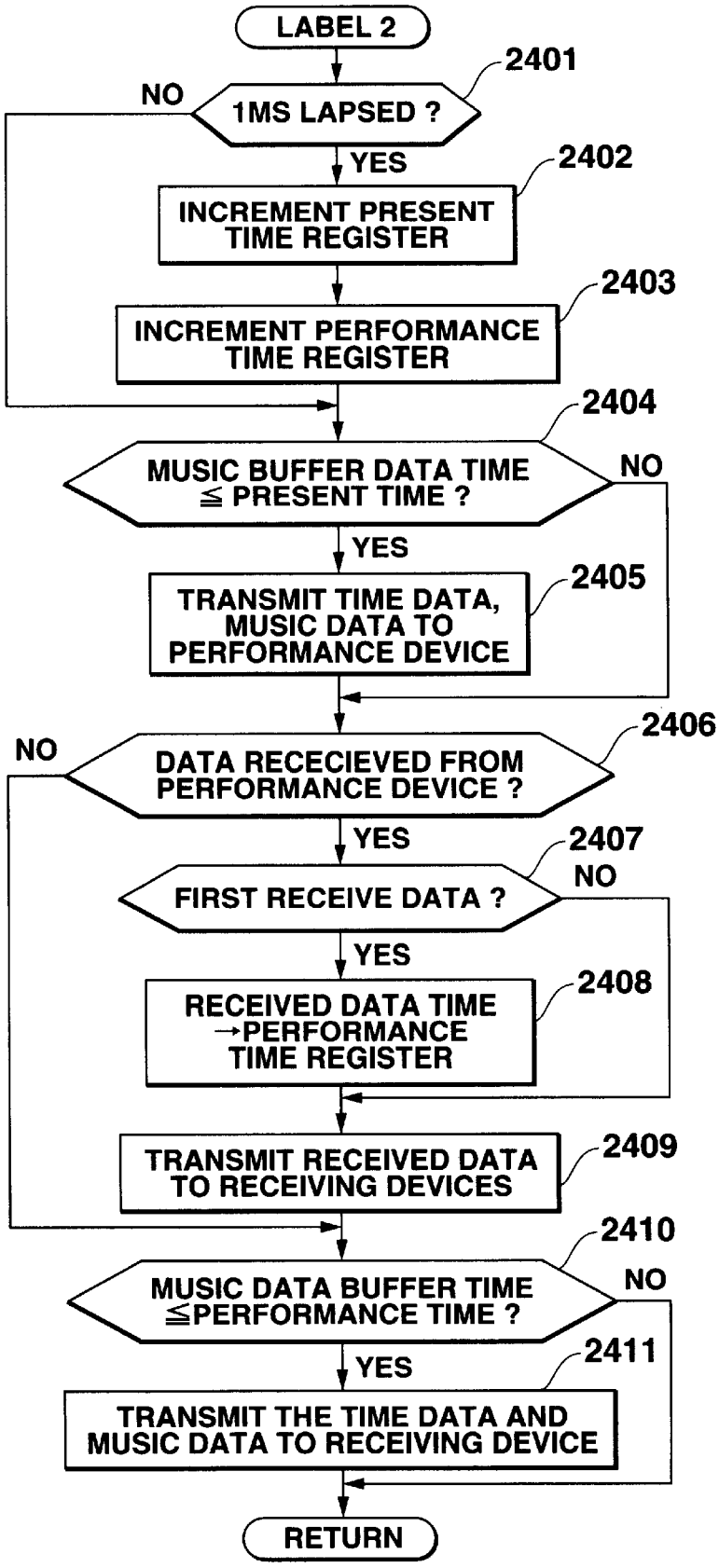
FIG. 24 is a flowchart of a label 2 process in the third embodiment.

FIG. 23 is a flowchart of a music information transmitting/receiving process effected by the CPU 101 of the database 2002. Referring to FIGS. 23 and 24, the control operation of the CPU 101 will be described next in detail.

The music information transmitting/receiving process is effected in the database 2002 when the user manipulates the switch group 115 to cause the musical sound generator to function as a database, to specify performance data to be transmitted, and destination devices such as the performance device 2001 and receiving devices 2003–2005, and then to instruct the database 2002 to start transmission of the performance data to thereby cause the CPU 101 to execute an appropriate program stored in the ROM 103.

First, in step 2301, the CPU 101 effects initialization to thereby clear the values of variables in the present time register and the performance time register used for transmitting the performance data, and to substitute initial values into those variables, to provide an area in the RAM 104 used for storing the performance data to be delivered (hereinafter, referred to as a music data buffer).

Then, the CPU 101 shifts its control to step 2302, where the CPU 101 reads out the performance data specified by the user from the ROM 103 and then stores it in the music data buffer. In step 2303, the CPU 101 effects the label 2 process which includes transmission and reception of performance data to/from a specified destination device or transmits performance data to a specified destination device.

Then, the CPU 101 shifts its control to step 2304, where it determines whether transmission/reception of the music information has been terminated. Since the performance device 2001 transmits to the database 2002 and the receiving devices 2003–2005 data on an ensemble which includes the contents of the user's performance and a performance based on the performance data received from the database 2002, termination of transmission of the performance data specified by the user arrivals earlier at the database device 2002 than at the respective receiving devices 2003–2005 because the termination of transmission of the performance data from the database 2002 to the receiving devices is effected via the database 2002. Thus, when the respective receiving devices 2003–2005 receive no performance data from the performance device 2001 for more than a predetermined time after the transmission of the performance data from the performance device 2001 to the respective receiving devices 2003–2005 or when the user instructs the performance device to stop transmission of the performance data with the switch group 115, the determination in step 2304 becomes YES, and the CPU 101 then terminates the process. If otherwise in step 2304, the determination becomes NO, and the CPU 101 returns its control to step 2303, where it effects the label 2 process again.

The steps 2303 and 2304 compose a processing loop whose looping process continues until the determination in step 2304 becomes YES. Thus, the performance data is transmitted/received between the database 2002 and the performance device 2001, and is transmitted to the respective receiving devices 2003–2005.

FIG. 24 is a flowchart of the label 2 process effected in step 2303, which will be described next in detail. As described above, the database 2002 transmits the same performance data in units of MIDI data to the performance device 2001 and the respective receiving devices 2003–2005, but the timings at which the performance data are received by the performance device 2001 and the receiving devices 2003–2005 are different because different times are required for the respective transmissions of the performance data. The same MIDI data is transmitted at an earlier timing to the performance device 2001 than to the receiving devices 2003–2005. The present time register and the performance time register are variables prepared to separately control the timings of transmitting the MIDI data to the performance device 2001 and the respective receiving devices 2003–2005.

First, in step 2401, the CPU 101 determines whether one millisecond has lapsed in the present time register since its value was updated last. If there is a difference of a value corresponding to at least one millisecond between the value of the timer 102 updated last and the present value of the timer 102, the determination becomes YES. Thus, the CPU 101 increments the respective values of the present time register and the performance time register (steps 2402 and 2403), and then shifts its control to step 2404. If otherwise in step 2401, the determination becomes NO, and the CPU 101 shifts its control to step 2404.

In step 2404, the CPU 101 determines whether a timing of transmitting to the performance device 2001 next MIDI data selected among the MIDI data stored in the music data buffer has come. When the value of the time data added to the selected MIDI data is smaller than the value of the present time register, the determination becomes YES. Thus, in step 2405, the CPU 101 causes the transmitter 108 to transmit the MIDI data and the time data to the performance device 2001. Then, the CPU 101 shifts its control to step 2406. If otherwise in step 2404, the determination becomes NO, and the CPU 101 then shifts its control to step 2406.

In step 2406, the database 2002 inquires the sever through the receiver 107 of whether there is any data received for the database. If there is, the database downloads the data and the CPU 101 determines whether the data is MIDI data received from the performance device 2001. If data on the transmission source added to the received data indicates the performance device 2001, the determination becomes Yes, and the CPU 101 shifts its control to step 2407. If otherwise in step 2406, the determination becomes NO, and the CPU 101 then shifts its control to step 2410.

In step 2407, the CPU 101 determines whether the MIDI data received by the receiver 107 is the first data received as music information from the performance device 2001. When the database starts to transmit the performance data to the performance device 2001, and then the user starts to manipulate the keyboard 130 of the performance device 2001, the database 2002 receives first MIDI data. Thus, the determination becomes YES. Thus, in step 2408, the CPU 101 substitutes the time data added to the MIDI data into the performance time register, and then shifts its control to step 2409. If otherwise in step 2407, the determination becomes NO, and the CPU 101 shifts its control to step 2409, where the CPU 101 causes the transmitter 108 to transmit the MIDI data and time data received from the performance device 2001 to the respective receiving devices 2003–2005.

As described above, the database 2002 substitutes the time data received first from the performance device 2001 into the performance time register. The time data represents the time counted, using as an initial value the value of the time data received first from the database 2002. Thus, as will be described later, only by merely comparing the value of the performance time register and the time data and then specifying a timing of transmitting the value of the performance time register based on the result of the comparison, a possible discrepancy in timing between the transmissions of the performance data specified by the user and the performance data received from the performance device 2001 in units of MIDI data to the respective receiving devices 2003–2005 is avoided. Thus, the respective receiving devices 2003–2005 reproduce those performance data synchronously.

Then, in step 2410, the CPU 101 determines whether the timing of transmitting to the respective receiving devices 2003–2005 next MIDI data selected from among the MIDI data stored in the music data buffer has come. When the value of the time data added to the MIDI data becomes smaller than the value of the performance time register, the determination becomes YES. Thus, in step 2411, the CPU 101 causes the transmitter 108 to transmit the MIDI data and time data to the respective receiving devices 2003–2005 in step 2411, and then terminates the process. If otherwise, the determination becomes NO, and the CPU 101 then terminates the process.

Figure 25:
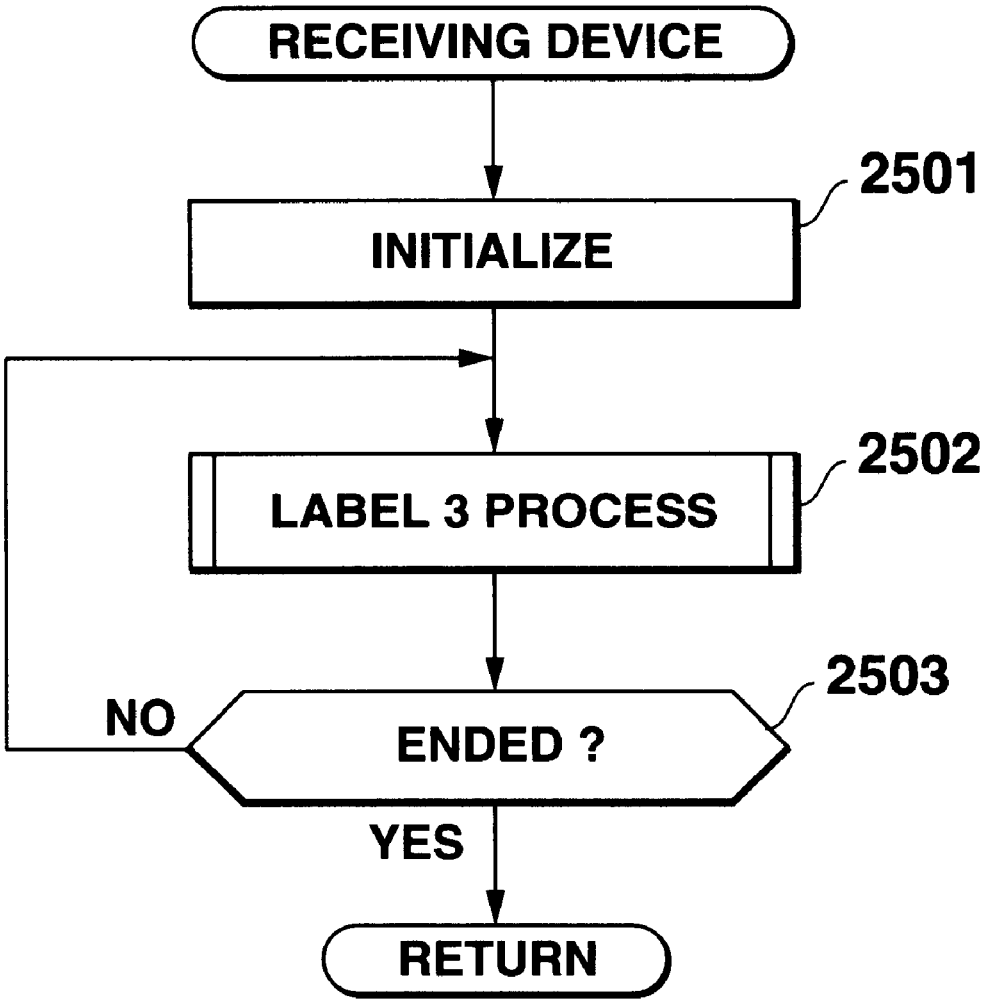
FIG. 25 is a flowchart of a music information receiving process effected by a receiving device in the third embodiment.

FIG. 25 is a flowchart of a music information receiving process effected by the CPU 101 of each of the receiving devices 2003–2005, which will be described next. When the user specifies with the switch group 115 that the music information transmitting/receiving apparatus should function as a receiving device, the CPU 101 executes a relevant program stored in the ROM 103 to effect the music information receiving process.

First, in step 2501, the CPU 101 effects initialization which includes clearing the values set in the respective variables and substituting preset values into the variables, and securing in the RAM 104 an area which temporarily stores the received performance data (hereinafter referred to as a received music data buffer). Then, in step 2502, the CPU 101 effects the label 3 process, which includes receiving performance data received from the database 2002 and reproducing it.

The CPU 101 then shifts its control to step 2503, where it determines whether the reception of the music information has been completed. When the receiver has not received the performance data from the database 2002 for more than a predetermined time or when the user manipulates the switch group 115 to instruct the receiver to stop reception of the performance data, the determination in step 2503 becomes YES, and the CPU 101 then terminates the process. If otherwise in step 2503, the determination becomes NO, and the CPU 101 then returns its control to step 2502, where it effects the label 3 process.

The steps 2502 and 2503 compose a processing loop whose looping operation continues until the determination in step 2503 becomes YES. Thus, the receiver sequentially receives MIDI data from the database 2002 and processes them to thereby effect an automatic performance.

Figure 26:
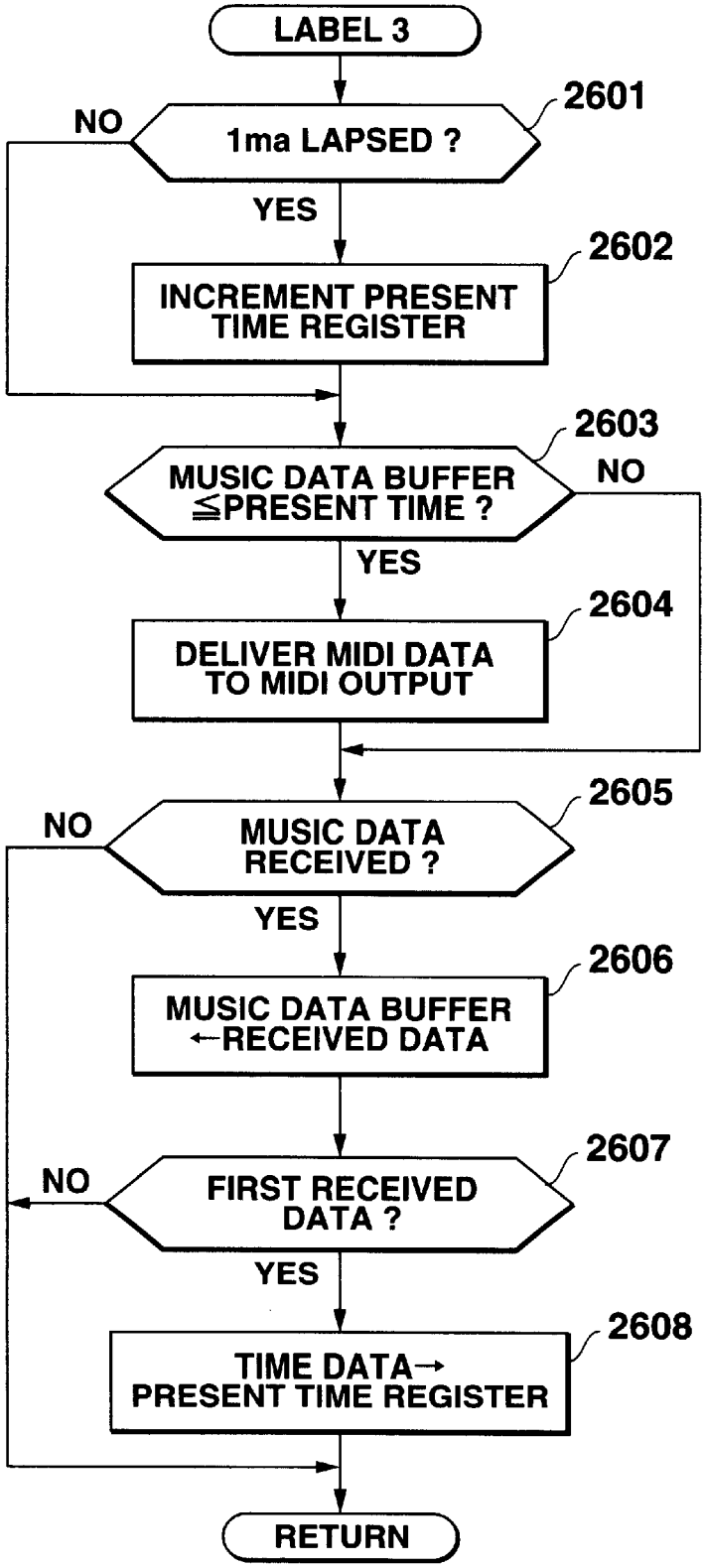
FIG. 26 is a flowchart of a label 3 process in the third embodiment.

FIG. 26 is a flowchart of the label 3 process effected in step 2502. Referring to FIG. 26, the label 3 process will be described in detail.

First, in step 2601, the CPU 101 determines whether one millisecond has lapsed since the value of the present time register was updated last. When there is a difference of a value corresponding to at least one millisecond between the value of the timer 102 updated last and the present value of the timer 102, the determination becomes YES. Thus, the CPU 101 increments the value of the present time register in step 2602, and then shifts its control to step 2603. If otherwise in step 2601, the determination becomes NO, and the CPU 101 shifts its control to step 2603.

In step 2603, the CPU 101 determines whether the timing of processing next MIDI data selected from among the MIDI data stored in the received music data buffer has come. When the value of the time data added to the selected MIDI data becomes smaller than the value of the present time register, the determination becomes YES. Thus, the CPU 101 delivers the item of MIDI data to the MIDI OUT terminal 113 in step 2604, and then shifts its control to step 2605. If otherwise in step 2603, the determination becomes NO, and the CPU 101 shifts its control to step 2605.

In step 2605, the CPU 101 inquires the sever through the receiver 107 of whether there is transmitted data for the receiving device thereof. When the database 2002 has transmitted MIDI data to the receiving device, the termination becomes YES. Thus, the CPU 101 down-loads the data in step 2606, receives the data from the receiver 107, stores it in the received music data buffer, and then shifts its control to step 2607. If otherwise in step 2605, the determination becomes NO, and the CPU 101 then terminates the process.

In step 2607, the CPU 101 determines whether the data stored last in the received music data buffer in step 2606 is the first data received as music information (MIDI data) from the database 2002. If the data is so, the determination becomes YES. Thus, the CPU 101 substitutes the time data added to the received first data into the present time register in step 2608, and then terminate the process. If otherwise in step 2607, the determination becomes NO, and the CPU 101 then terminates process.

As described above, the respective receiving devices 2003–2005 substitute the time data received first from the database 2002 into the respective present time registers. Thus, only by comparing the time data added to the received MIDI data with the value of the present time register, the MIDI data is processed at an appropriate timing based on the comparison whether or not the MIDI data is the performance data specified by the user or the performance data produced by the performance device 2001. As a result, the respective receiving devices 2003–2005 faithfully reproduce an ensemble effected by the performance device 2001.

While in the third embodiment the database 2002 is illustrated as transmitting two different items of music information to the performance device 2001 and the group of receiving devices 2003–2005, respectively, the music information may be further divided into more items which are then transmitted to the performance device 2001 and other receiving devices 2003–2005. The contents of the music information to be transmitted may be specified in accordance with a part and tone quality.

While the database 2002 is illustrated as receiving music information from the performance device 2001, it may be used for merely transmitting music information to external devices without receiving music information from the external devices. In this case, no receiver 107 is required to be provided.

<Fourth Embodiment>

An ensemble or a contest (both are each represented as a session) cannot be held unless a plurality of performers collects at a single place—place restrictions. The fourth embodiment is intended to eliminate such restrictions and allows a plurality of performers to enjoy a session even when they do not collect in a single place.

A musical sound generator, which includes the musical sound transmitting/receiving apparatus according to the fourth embodiment, is basically the same in composition as that of the first embodiment (FIG. 1). Therefore, also, in the fourth embodiment, the reference numerals used for the description of the first embodiment are used basically as in the second and third embodiments. Now the fourth embodiment will be described with reference to FIG. 1.

Figure 27:
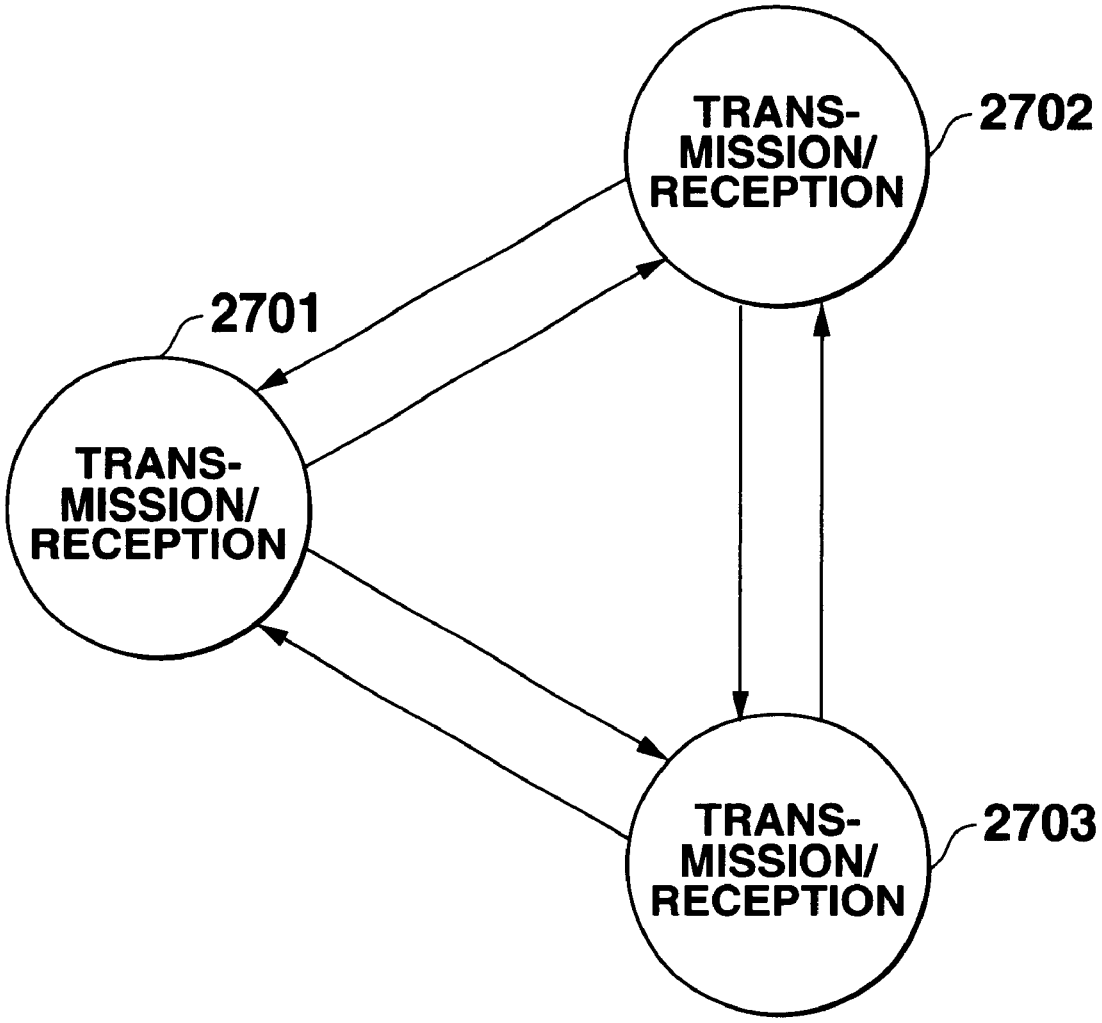
FIG. 27 illustrates a method of utilizing a musical sound generating apparatus which includes a music information transmitting-receiving apparatus as a fourth embodiment of the present invention.

FIG. 27 illustrates a method of using the musical sound generator of the fourth embodiment. First, referring to FIG. 27, the method of using the musical sound generator and the operation of the generator, which enables the use of the musical sound generator, will be described next.

Reference numerals 2701–2703 of FIG. 27 denote musical sound generators each having the same composition as that of FIG. 1. Arrows illustrate that the musical sound generator 2701 transmits and receives music information to and from the musical sound generators 2702 and 2703 and that the musical sound generator 2702 transmits and receives music information to and from the musical sound generators 2701 and 2703. Like the first-third embodiments, the devices 2701–2703 are connected to a LAN.

When music information is transmitted to a performer at a relatively remote position, some delay will occur. Thus, in real time processing, a discrepancy in performance timing between the performers cannot be avoided in principle. That is, one performer will necessarily notice by hearing another performer's performance that there is a deviation in timing between the former performance and the latter one.

In an actual session, in order to avoid such deviation, the same melody can be performed repeatedly in such a manner that each time each performer repeats a take, starting with a performance faithful to a musical score, the contents of the respective performances are adjusted. Since in the fourth embodiment a discrepancy between the performers' performances cannot be avoided in the real time processing, and when a session, which repeats a take, is held, the respective takes are performed more appropriately as follows. Here, for convenience' sake, a session which is held with melodies corresponding to performance data which the respective devices 2701–2703 of FIG. 27 have will be illustrated as an example. Since the operations of the respective devices 2701–2703 are basically the same, the device 2701 will be described as an example.

The performance data does not contain the intention of performance of the respective performers and has a plurality of parts. When the performance data is specified by the user (performer) of the musical sound generator 2701 with the switch group 115, it is read by the CPU 101 from the ROM 103, and then stored in an area provided in the RAM 104 (hereinafter referred to as a music track buffer).

The user (performer) of the musical sound generator 2701, for example, specifies a mute for a sound of a part performed by the user to reproduce the performance data (minus one performance) and performs a desired part to the performance. The CPU 101 receives MIDI data indicative of the performance contents of the part from the MIDI IN terminal 114, adds to the MIDI data time data which specifies timings of processing or reproducing the MIDI data at the receiving devices, and transmits resultant data as music information to the respective devices 2702 and 2703 as requested.

Time data representing a processing timing whose reference is the start of the performance is added to the MIDI data of the performance data. Thus, a time recorded since the start of reproduction of the performance data as a reference is added as time data to the MIDI data to be transmitted. In order to record time, a performance time register as a variable is used.

Similarly, the musical sound generators 2702 and 2703 transmit the music information indicative of the contents of the performances effected by the respective users to other devices. When the musical sound generator 2701 receives the music information transmitted by the musical sound generators 2702 and 2703, it stores the received music information for each generator (corresponding to a part (track)) in an area (hereinafter referred to as a received music data buffer) provided in the RAM 104.

The performance data stored in the received music data buffer is written over data corresponding to the part of the performance data stored in the music track buffer after the termination of the user's performance. The performance data stored in the music track buffer is updated with contents of the performances effected last by the respective performers (herein, two). Thus, the user of the musical sound generator 2701 can effect an ensemble with the performances which the respective users of the musical sound generators 2702 and 2703 effected last. The devices 2702 and 2703 add time data to the respective MIDI data and then transmit them. Thus, even when the updated performance data is reproduced and a related ensemble is performed, a discrepancy in timing between the performance effected by the device 2701 and the performances effected last by the devices 2702 and 2703 is avoided. As a result, the user of the musical sound generator 2701 can repeat a take comfortably while feeling as if the user were together with other performers (the users of the devices 2702 and 2703) at a single place.

Transmission/reception and update of the performance data, as described above, are effected when the user sets a predetermined mode (hereinafter, for convenience's sake, referred to as a session mode) with the switch group 115. In the present embodiment, in order to facilitate the update of the performance data, performance data edited in units of a part are used and stored in the ROM 103.

The control operation of the CPU 101 of the musical sound generators 2701–2703 to realize their operations will be described next in detail with reference to FIGS. 28–33. The operations of the devices 2701–2703 are basically the same, and hence only the operation of the device 2701 will be described herein.

Figure 28:
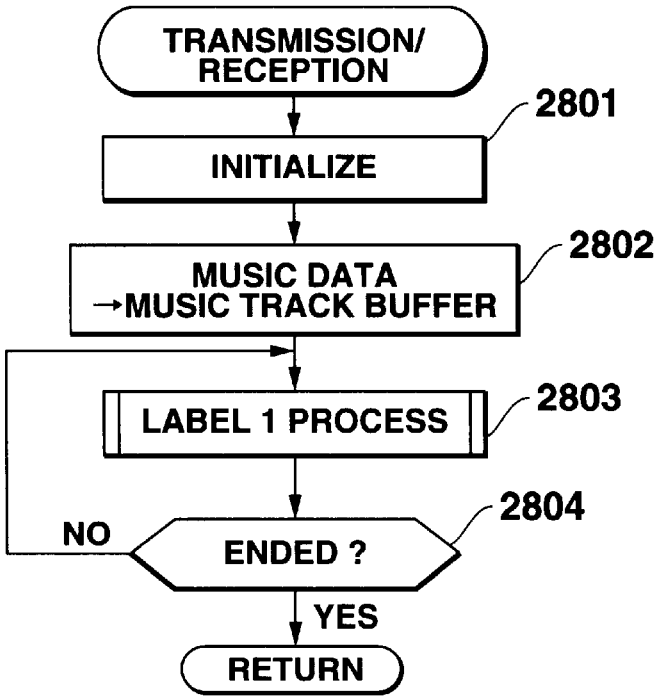
FIG. 28 is a flowchart of a music information transmitting-receiving process in the fourth embodiment.

FIG. 28 is a flowchart of a musical information transmitting/receiving process effected by the CPU 101 of the musical sound generator 2701. First, referring to FIG. 28, the contents of the processing by the CPU 101 will be described in detail.

The music information transmitting/receiving process is effected when the user of the musical sound generator 2701 manipulates the switch group 115 to set the session mode and to specify destination devices for performance data to be reproduced and hence the CPU 101 executes a relevant program stored in the ROM 103. The performance data to be specified can be predetermined as a united one among the performers (users) at the devices 2701–2703 who hold the session.

First, in step 2801 the CPU 101 effects initialization which includes clearing the value in the performance time register, substituting predetermined values into the respective variables and securing in the RAM 104 music track buffers used for temporarily storing performance data read out from the ROM 103 and a received music data buffer which temporarily hold the received performance data. Then in step 2802, the CPU 101 reads out the performance data specified by the user from the ROM 103, and then stores it in the music track buffer.

Then in step 2803, the CPU 101 updates the value of the performance time register as requested and then effects the label 1 process which includes transmission/reception of performance data to/from other devices 2702 and 2703, and update and reproduction of the performance data.

Then in step 2804, the CPU 101 determines whether the user has instructed the device 2701 to terminate the session. When the user manipulates the switch group 115 to instruct the device 2701 to release the session mode or to terminate reproduction of the performance data, the determination becomes YES and the CPU 101 then terminates the process. If otherwise n step 2804, the determination becomes NO and the CPU 101 returns its control to step 2803 to effect the label 1 process.

As described above, the steps 2803 and 2804 compose a processing loop whose looping operation continues until the determination in step 2804 becomes YES. Thus, the device 2701 effects transmission/reception of performance data to/from the other devices 2702 and 2703 and update and reproduction of the performance data.

Figure 29:
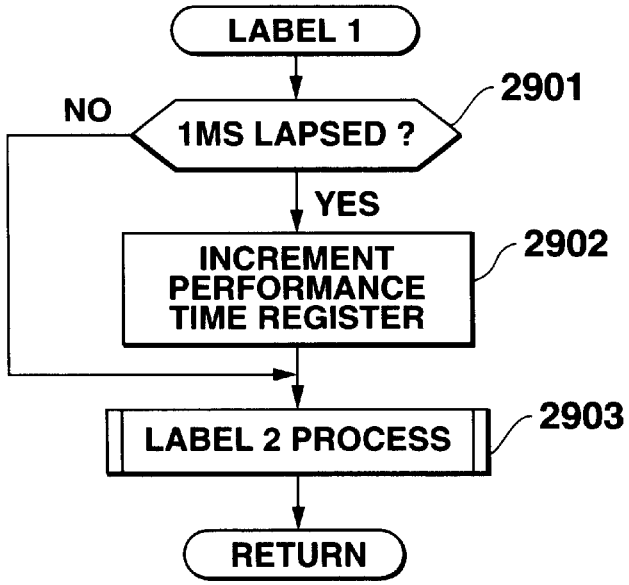
FIG. 29 is a flowchart of a label 1 process in the fourth embodiment.

FIG. 29 is a flowchart of the label 1 process effected in step 2803. Referring to FIG. 29, the label 2 process will be described next in detail.

First, in step 2901, the CPU 101 determines whether one millisecond has elapsed since the value of the performance time register was updated (incremented) last. When there is a difference of a value corresponding to at least one millisecond between the value of the timer 102 updated last and the present value of the timer, the determination becomes YES. Thus, the CPU 101 increments the value of the performance time register in step 2902, and then shifts its control to step 2903. If otherwise in step 2901, the determination becomes NO, and the CPU 101 shifts its control to step 2903.

In step 2903, the CPU 101 effects the label 2 process which includes transmission/reception of performance data to/from the other devices 2702 and 2703 and update and reproduction of the performance data. Then, the CPU 101 terminates the process.

Figure 30:
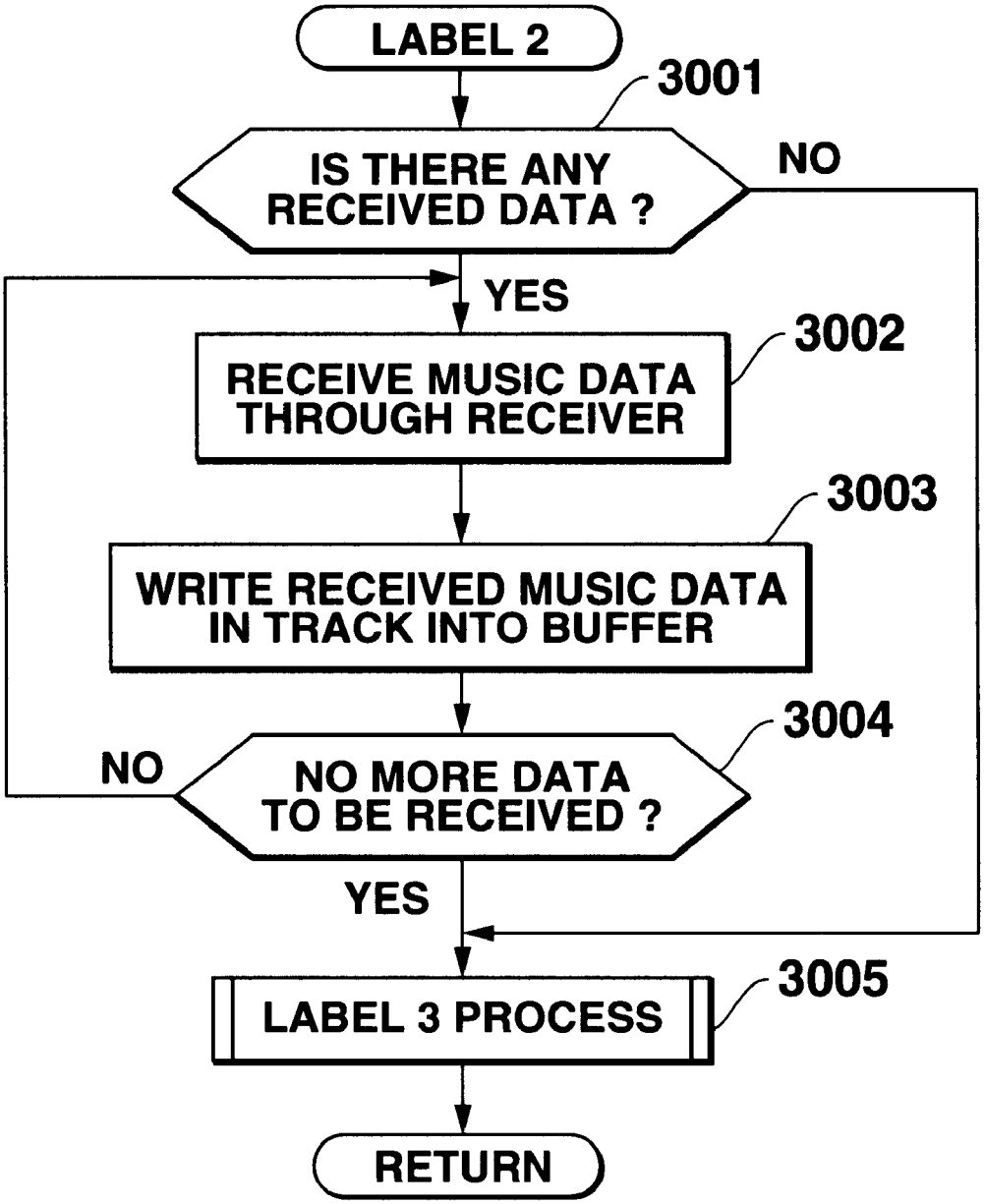
FIG. 30 is a flowchart of a label 2 process in the fourth embodiment.

FIG. 30 is a flowchart of the label 2 process effected in step 2803. Referring to FIG. 30, the label 2 process will be described next in detail.

Data is transmitted/received through the sever between the musical sound generators 2701–2703. First, in step 3001, the device 2701 inquires the sever of whether there is data received for the device 2701 from another device 2702 or 2703. If so, the determination becomes YES. The CPU 101 then shifts its control to step 3002. If otherwise, the determination becomes NO, and the CPU 101 shifts its control to step 3005.

In step 3002, the CPU 101 downloads data from the sever through the receiver 107. Then in step 3003, the CPU 101 stores the down-loaded data in an area in the received music data buffer specified by the transmission source. Then, in step 3004, the CPU 101 inquires the sever of whether there is further data to be downloaded from the sever. As a result, when the CPU 101 confirms that there is no more data to be down-loaded, the determination becomes NO. Step 3005 is next. If otherwise in step 3004, the determination becomes YES, and the CPU 101 returns its control to step 3002, which downloads required data.

After receiving the data from the other device 2702 or 2703, in step 3005 the CPU 101 effects the label 3 process which includes reproducing the performance data stored in the music track buffer, and transmitting the MIDI data indicative of the contents of the performance effected by the user to the devices 2072 and 2073 as requested. Then, the CPU 101 then terminates the process.

Figure 31:
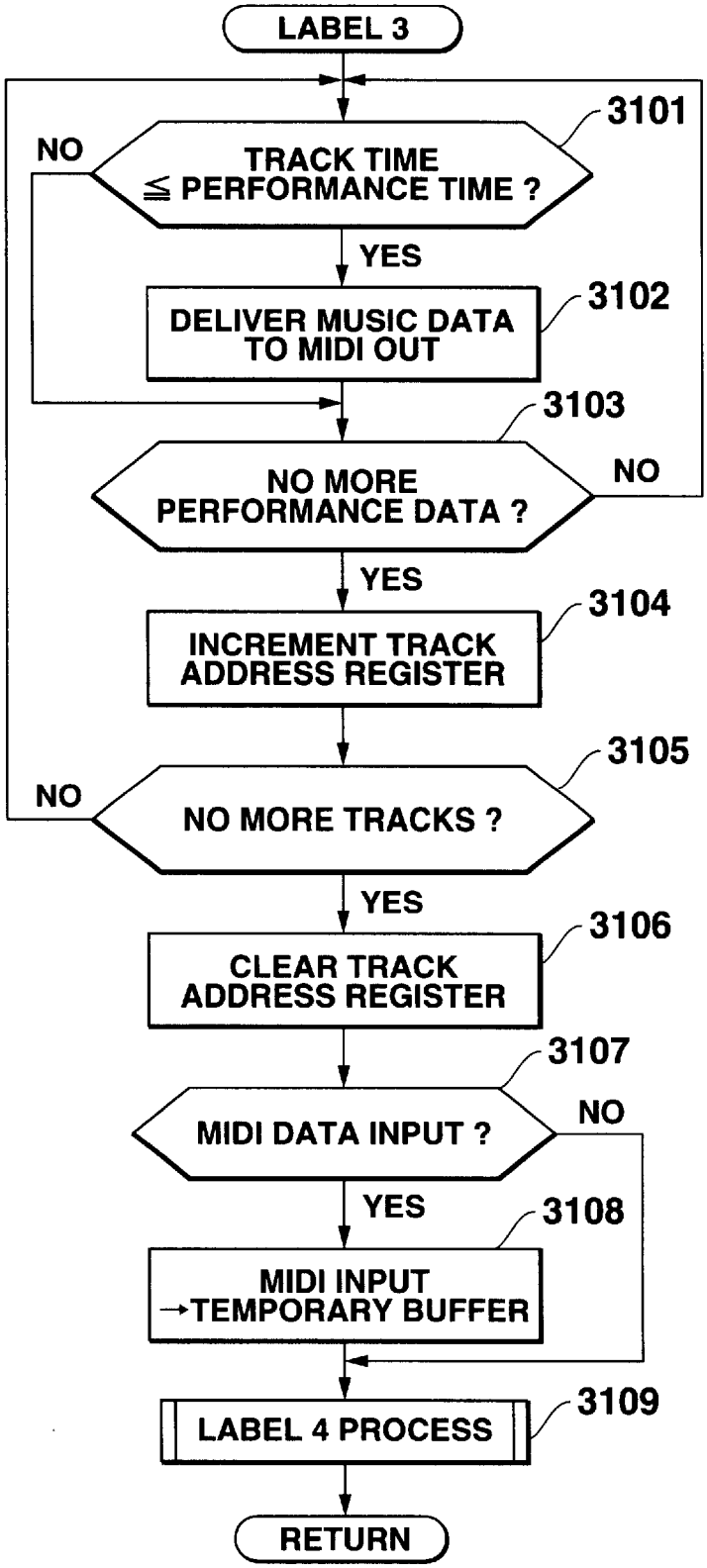
FIG. 31 is a flowchart of a label 3 process in the fourth embodiment.

FIG. 31 is a flowchart of the label 3 process effected in step 3005. Referring to FIG. 31, the label 3 process will be described next in detail.

As described above, in the present embodiment, performance data is employed which are separated for tracks corresponding to parts in order that the performance data stored in the music track buffer can easily updated. Thus, the performance data is reproduced while the tracks for the performance data to be produced in units of a track are being changed. The tracks to be reproduced are managed by the track address register which is a variable. The reproduction of performance data effected so is realized by effecting the steps 3101–3106.

First, in step 3101, the CPU 101 determines whether the value of time data added to an item of MIDI data to be processed next among the performance data in a track specified by the value of the track address register is more than the value of the performance time register. When a processing timing specified by the time data has come, the determination becomes YES and the CPU shifts its control to step 3102, where it delivers the MIDI data with the added time data to the MIDI OUT terminal 113, selects as next MIDI data that positioned next to the delivered MIDI data, and then shifts its control to step 3101. If otherwise in step 3101, the determination becomes NO, and the CPU 101 shifts its control to step 3103.

In step 3103, the CPU determines whether there are still MIDI data to be processed in the track of interest. When the determination in step 3103 is NO or all the MIDI data of the performance data in that track have been processed. The CPU 101 increments the value of the track address register in step 3104 and then shifts its control to step 3105. If otherwise, the determination becomes YES, and the CPU 101 returns its control to step 3101, where it effects the determination about the processing timing of MIDI data to be processed next.

In step 3105, the CPU determines whether there are still MIDI data in the track to be produced. When the value of the track address register is larger than a maximum one of the track numbers, in other words, when the performance data in all the tracks have been processed at the present time, the determination becomes NO. Thus, in step 3106 the CPU 101 clears (substitutes zero into) the track address register, and then shifts its control to step 3107. If otherwise in step 3105, the determination becomes YES, and the CPU 101 returns its control to step 3101, where it effects a process for reproducing performance data in a track as a new object.

In step 3107, the CPU determines whether MIDI IN terminal 114 has received MIDI data from the keyboard 130. When the MIDI IN terminal 114 has output a signal indicative of reception of the MIDI data, the determination becomes YES. Thus, in step 3108 the CPU 101 receives the MIDI data from the MIDI IN terminal 114, stores it in a temporary buffer, delivers it to the MIDI OUT terminal 113, and then shifts its control to step 3109. If otherwise in step 3107, the determination becomes NO, and the CPU 101 returns its control to step 3109. The temporary buffer is an area provided in the RAM 104 to temporarily hold the MIDI data output from the keyboard 130.

In step 3109, the CPU 101 effects the label 4 process, which includes transmission of the MIDI data, stored in the temporary buffer in step 3108 and completion of reproduction of the performance data. Then, the CPU 101 then terminates the process.

Figure 32:
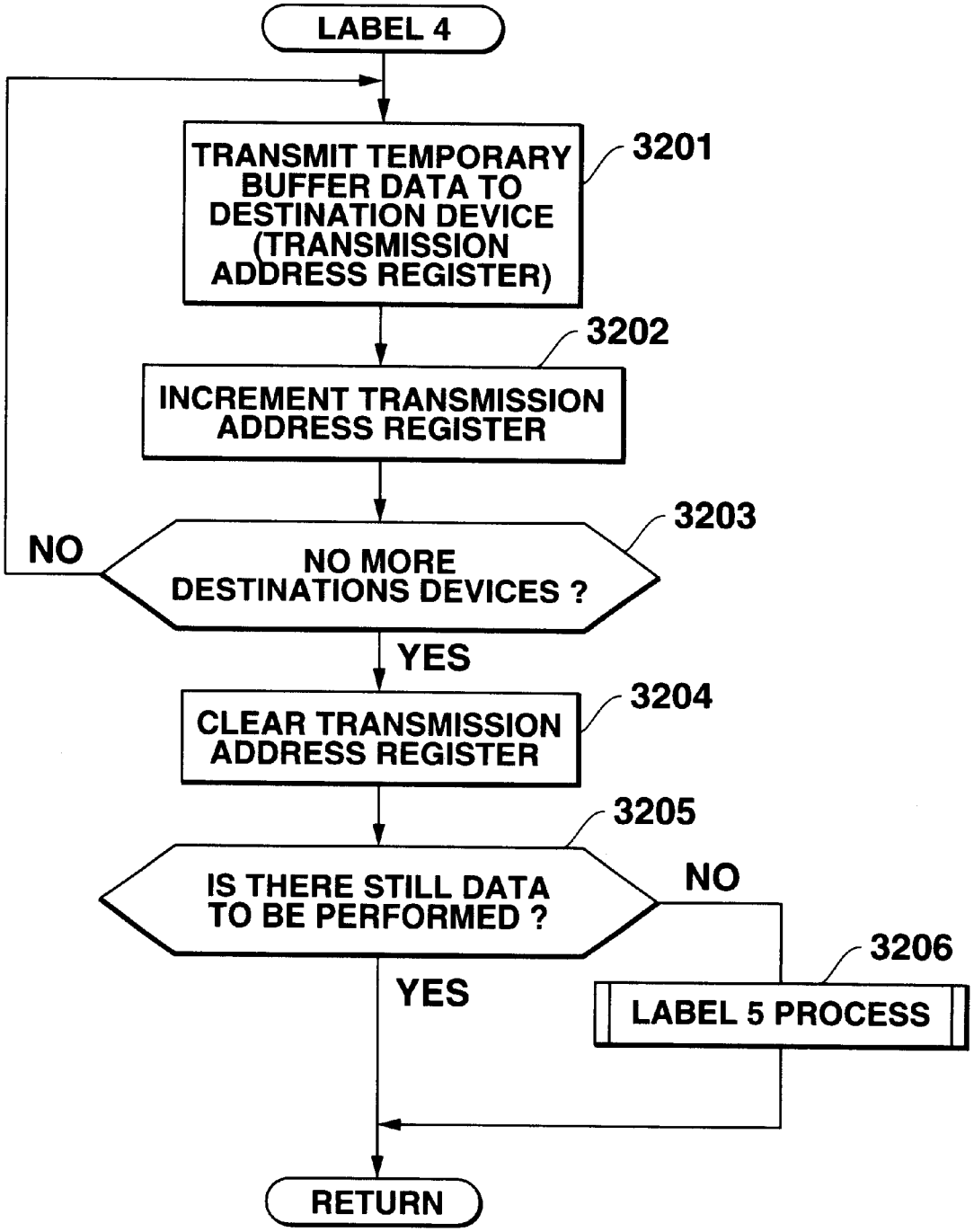
FIG. 32 is a flowchart of a label 4 process in the fourth embodiment.

FIG. 32 is a flowchart of the label 4 process to be effected in step 3109. Referring to FIG. 32, the label 4 process will be described in detail next.

The CPU 101 stores in the RAM 104 a list of destination devices (their addresses) which the user specified or input with the switch group 115 (hereinafter referred to also as a destination device list). The CPU 101 transmits the MIDI data input by the keyboard 130 by referring to the list. The destination device of the list is managed by a transmission address register, which includes a variable.

First, in step 3201, the CPU 101 reads out the MIDI data stored in the temporary buffer, adds a value of the performance time register as the time data to the MIDI data, and then transmits the resulting data to a destination device of the list specified by the value of the transmission address register by adding to the data (MIDI data and time data) a header which includes the destination device address and delivering it to the transmitter 108.

The performance time register includes a variable used for recording time in order to specify a timing for processing the MIDI data of the performance data. By adding the value of the register as time data to MIDI data, the performance of a part effected by the musical sound generator 2701 is reproduced synchronously with performance of another part effected in the destination device. Thus, even when the respective performers are in different places, they can repeat a take (session) while feeling as if they were together in a single place.

Then in step 3202, the CPU 101 increments the value of the transmission address register. Then, in step 3203, the CPU 101 determines whether data has been transmitted to the entire destination device. When the value of the transmission address register is larger than a maximum one of the numbers of the destination devices of the list, it is meant that the data has been transmitted to all the destination devices of the list. Thus, the determination becomes YES. Thus, in step 3204 the CPU 101 erases all the MIDI data in the temporary buffer, clears (substitutes zero into) the transmission address register, and then shifts its control to step 3205. If otherwise in step 3202, the determination becomes NO. Thus, the CPU 101 returns its control to step 3201, where it transmits data to the next destination device.

There may be a case where no MIDI data is stored in the temporary buffer in the execution of the label 4 process. In this case, the CPU 101 actually does not effect the steps 3201–3204, but shifts its control to step 3205.

In step 3205, the CPU 101 determines whether there are MIDI data which are not yet processed among the performance data stored in the music track buffer. If so, the determination becomes YES and the CPU 101 then terminates the process. If otherwise, the determination becomes NO, and the CPU 101 then shifts its control to step 3206.

In step 3206, the CPU 101 effects the label 5 process which includes copying the performance data received from the other devices 3207 and 3203 into the performance data stored in the music track buffer as requested. Then, the CPU 101 terminates the process.

As described above, in the present embodiment, it is supposed that the user effects an ensemble with a performance, which includes reproduction of the performance data. Thus, the CPU 101 updates the performance data when the reproduction of the performance data is completed. Thus, the respective performers are capable of adjusting their respective performances to others performances.

Figure 33:
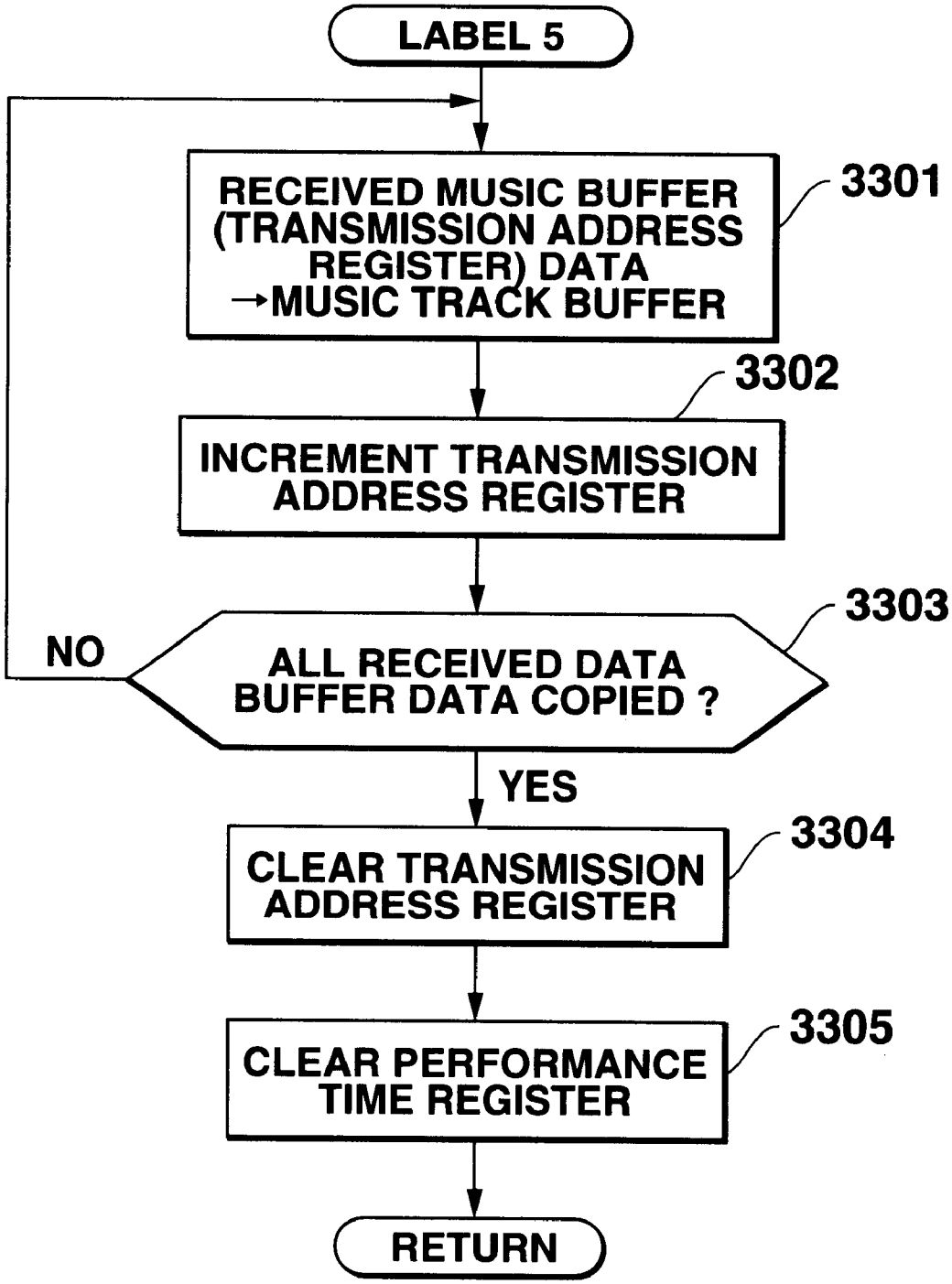
FIG. 33 is a flowchart of a label 5 process in the fourth embodiment.

FIG. 33 is a flowchart of the label 3 process effected in step 3206. Referring to FIG. 33, the label 5 process will be described in detail. As described above, the CPU 101 of the generator 2701 stores the performance data received from the other musical sound generators 2702 and 2703 separately for the respective generators (parts) in the received music data buffer. Thus, the received performance data are copied sequentially in units of a generator (part) into the performance data stored in the music track buffer. The performance data to be copied is managed by the transmission address register because the performance data is supposed to be received from the respective destination devices of the list.

First, in step 3301, the CPU 101 writes over a track specified by the value of the transmission address register performance data in the received music data buffer corresponding to the track among the performance data of the music track buffer. Thus, performance data for one part is copied. Of course, this coping is not effected when there are no performance data to be copied in the received music data buffer.

Then, in step 3302, the CPU 101 increments the value of the transmission address register. Then, the CPU 101 shifts its control to step 3303, where it determines whether all the performance data stored in the received music data buffer have been copied. When the value of the transmission address register is larger than a maximum one of the numbers of the destination devices of the list, it is meant that all the performance data received from the destination devices of the list have been copied. Thus, the determination becomes YES, and the CPU 101 shifts its control to step 3304. If otherwise in step 3303, the determination becomes NO, and the CPU 101 returns its control to step 3301, where it copies another performance data in the received music data buffer into the performance data of the music track buffer.

As described above, the steps 3301–3303 compose a processing loop whose looping operation updates the performance data stored in the music track buffer in units of a part (device).

After the determination in step 3303 becomes YES, the CPU 101 clears the values of the transmission address register and the performance time register (step 3304, 3305). Then, the CPU 101 then terminates the process.

When the label 5 process is terminated, the label 1 process in step 2803 of the music information transmitting/receiving process of FIG. 28 is also terminated. When the determination in step 2804 is NO, that is, when the user does not instruct the device to stop the performance, the user is forced to start the next performance immediately after the present performance is effected. However, that is not desirable because the respective performer's circumstances are ignored. Thus, when the reproduction of the performance data is completed, the CPU 101 shifts its control from step 2804 to step 2893 after predetermined conditions are satisfied, for example, a predetermined time after the reproduction of the performance data was terminated or when all the performers have manually expressed that they are ready for the next processing. In that case, the respective performers can repeat a take (session) as if they were together in a single place.

While in the fourth embodiment the secession held by the three performers is illustrated as an example, of course, the number of performers is not limited to three. While the performance data is illustrated as being updated in each session, the performance data may be updated according to another criterion, for example, at predetermined intervals of time. In that case, a practice time may be given to each of the performers to adjust their respective performances.

While in the fourth embodiment one device is illustrated as transmitting/receiving music information to/from a plurality of other devices, it may transmit/receive the music information to/from one device. In addition, one of transmission/reception of the music information may be selected in accordance with each performer's ability.

While the first-fourth embodiments are realized as devices provided in the musical sound generators, the apparatuses in which the first-fourth embodiments are included are not limited to electronic musical instruments and other musical sound generators such as various controllers and sequencers. They may be provided on personal computers. Of course, the apparatuses in which the respective inventive devices are provided are not necessarily required to have all the functions of transmitting/receiving the music information, but may include one of the functions of transmitting/receiving the music information depending on respective environments where they are supposed to be used.

Provision of the inventive devices in the personal computers is achieved by loading on the computers programs which realizes the above operations on the computers. The programs may be recorded and distributed in portable recording mediums such as CD-ROMs and floppy desks or obtained through some telecommunication lines from external devices.

What is claimed is:

1. A music information transmitting apparatus comprising:

event data acquiring means for acquiring event data indicating the contents of a performance effected by a user;

event data transmitting means for transmitting music information obtained by adding first time data indicating a timing which a receiving end should process to the event data obtained by the event data acquiring means;

waveform data acquiring means for acquiring acoustic waveform data;

waveform data transmitting means for transmitting to the receiving end music information acquired by the waveform data acquiring means; and time data transmitting means for transmitting as music information second time data specifying a timing at which the receiving end should process waveform data transmitted by the waveform data transmitting means.

2. The music information transmitting apparatus according to claim 1, wherein said waveform data transmitting means transmits the waveform data acquired by said waveform data acquiring means along with serial data representing the order of the transmitted waveform data.

3. The music information transmitting apparatus according to claim 1, wherein said time data transmitting means transmits size data representing a size of the waveform data transmitted by said waveform data transmitting means in addition to the second time data.

4. A music information receiving apparatus comprising:

receiving means for receiving music information;

a music data buffer, responsive to the receiving means receiving event data and first time data as the music information, for storing the received event data and first time data;

a waveform buffer for storing waveform data;

storage controlling means, responsive to the receiving means receiving waveform data as the music information, for storing the received waveform data in the waveform buffer;

waveform processing means, responsive to the receiving means receiving second time data as the music information, for processing the waveform data stored in the waveform buffer at a timing specified by the second time data;

a musical-sound generating time register for storing the received second time data as a musical sound generating time;

incrementing means for incrementing the musical sound generating time, stored in the musical-sound generating time register, at predetermined timings; and event processing means for processing the event data stored in the music data buffer at a timing determined on the basis of the musical sound generating time stored in the musical-sound generating time register and the first time data stored in the music data buffer.

5. The music information transmitting apparatus according to claim 4, wherein said storage controlling means comprises storage means for storing reception serial data representing the order of received waveform data, and wherein when transmission serial data representing the order of the transmitted waveform data is added to waveform data received by said receiving means and only when said transmission serial data coincides with the reception serial data stored in said storage means, said storage means stores the waveform data in said waveform buffer.

6. The music information transmitting apparatus according to claim 4, wherein said waveform processing means comprises storage means for storing reception size data representing a size of the received waveform data, and wherein when transmission size data representing a size of transmitted waveform data is added to the second time data received by said receiving means and only when said transmission size data coincides with the reception size data stored in said storage means, said waveform processing means processes the waveform data at a timing specified by the second time data.

7. A music information editing apparatus comprising:

transmission requesting means for transmitting a transmission request to a plurality of external devices;

receiving means, responsive to the transmission request transmitted by the transmission requesting means, for receiving from the plurality of external devices music information which comprises event data representing contents of an event in a performance and time data representing a timing for processing the event data added to the event data;

music information storing means for storing the music information received by the receiving means; and music information editing means for rearranging the music information stored in the music information storing means in accordance with a processing sequence specified by the time data of the music information.

8. A music information transmitting apparatus comprising:

music information storing means for storing music information which comprises event data representing contents of an event in a performance and first time data representing a timing for processing the event data added to the event data;

music information processing means for processing and reproducing an event of the music information stored in the music information storing means;

event data acquiring means for acquiring event data representing contents of a performance effected by a user during the time when the music information stored in the music information storing means is processed by the music information processing means;

time data adding means for generating second time data representing a timing for processing the event data acquired by the event data acquiring means on the basis of the first time data of the music information stored in the music information storing means, and for adding the generated second time data to the event data acquired by the event data acquiring means;

first transmission means for transmitting as music information the event data and the second time data added to the event data by the time data adding means; and second transmission means for transmitting the music information, stored in the music information storing means, at a timing based on the second time data added to the event data transmitted by the first transmission means.

9. The music information transmitting apparatus according to claim 8, wherein said music information storing means comprises a further transmission means for transmitting music information stored therein to said music information processing means, and said music information processing means comprises receiving means for receiving the music information transmitted by said further transmission means.

10. The music information transmitting apparatus according to claim 9, wherein said time data adding means generates the time data representing the timing for processing the event data, based on the time data added to the event data first received by said receiving means, and adds the generated time data to the event data acquired by said event data acquiring means.

11. The music information transmitting apparatus according to claim 8, wherein said second transmission means transmits the music information at a timing based on the time data added to the event data transmitted first by said first transmission means.

12. A music information transmitting-receiving apparatus comprising:

receiving means for receiving music information transmitted by a plurality of external devices;

music information storing means having a plurality of storage regions corresponding to the plurality of external devices, respectively;

storage controlling means, responsive to reception of music information by the receiving means, for storing the received music information in a corresponding storage region of the music information storing means;

music information processing means for processing and reproducing an event of the music information stored in the music information storing means;

event data acquiring means for acquiring event data representing contents of a performance effected by a user during time when the music information stored in the music information storing means is processed by the music information processing means; and transmission means for transmitting the event data acquired by the event data acquiring means to the plurality of external devices, respectively.

13. A recording medium which contains a computer readable program for:

acquiring event data indicating contents of a performance effected by a user;

transmitting music information obtained by adding first time data indicating a timing which a receiving end should process to the acquired event data;

acquiring acoustic waveform data;

transmitting to the receiving end the acquired acoustic waveform data as music information; and transmitting as music information second time data specifying a timing at which the receiving end should process the transmitted acoustic waveform data.

14. A recording medium which contains a computer readable program for:

receiving music information;

in response to the reception of event data and first time data as the music information, storing the received event data and first time data in a music data buffer;

in response to the reception of waveform data as the music information, storing the received waveform data in a waveform buffer;

in response to the reception of second time data as the music information, reproducing the waveform data stored in the waveform buffer, at a timing specified by the received second time data;

storing the received second time data as a musical sound generating time;

incrementing a musical-sound generating time, stored in a musical-sound generating time register, at predetermined timings; and reproducing the event data stored in the music data buffer at a timing determined on the basis of the musical sound generating time stored in the musical-sound generating time register and the first time data stored in the music data buffer.

15. A recording medium which contains a computer readable program for:

transmitting a transmission request to a plurality of external devices;

in response to the transmitted transmission request, receiving from the plurality of external devices music information which comprises event data representing the contents of an event in a performance and time data representing a timing for processing the event data added to the event data;

storing the received music information in a music information storage memory; and rearranging the music information stored in the music information storage memory in accordance with a processing sequence specified by the time data of the music information.

16. A recording medium which contains a computer readable program for:

processing and reproducing an event of music information stored in a music information storage memory, the music information comprising event data representing contents of an event in a performance and first time data representing a timing for processing the event data added to the event data;

acquiring event data representing contents of a performance effected by a user during the time when the music information stored in the music information storage memory is reprocessed;

generating second time data representing a timing for reprocessing the acquired event data on the basis of the first time data of the music information stored in the music information storage memory, and for adding the generated second time data to the acquired event data;

transmitting as music information the event data and the second time data added to the event data; and transmitting the music information, stored in the music information storage memory, at a timing based on the second time data added to the transmitted event data.

17. A recording medium which contains a computer readable program for:

receiving music information transmitted by a plurality of external devices;

in response to the reception of music information, storing the received music information in a corresponding storage region of a music information storage memory;

processing and reproducing an event of the music information stored in the music information storage memory;

acquiring event data representing contents of a performance effected by a user during the time when the music information stored in the music information storage memory is reprocessed; and transmitting the acquired event data to the plurality of external devices, respectively.

* * * * *